US012667747B2

(12) United States Patent
Liu et al.

(10) Patent No.: US 12,667,747 B2
(45) Date of Patent: Jun. 30, 2026

(54) TRAMPOLINE AND SPORTS DEVICE

(71) Applicant: Dazhong Liu, Beijing (CN)

(72) Inventors: Dazhong Liu, Beijing (CN); Ziyang Liu, Beijing (CN)

(73) Assignee: Dazhong Liu, Beijing (CN)

( * ) Notice: Subject to any disclaimer, the term of this patent is extended or adjusted under 35 U.S.C. 154(b) by 87 days.

(21) Appl. No.: 18/413,705

(22) Filed: Jan. 16, 2024

(65) Prior Publication Data

US 2025/0121243 A1 Apr. 17, 2025

(30) Foreign Application Priority Data

Oct. 12, 2023 (CN) ..... 202311321877.6

(51) Int. Cl.
*A63B 5/11* (2006.01)
*A63B 21/00* (2006.01)
*A63B 21/04* (2006.01)

(52) U.S. Cl.
CPC ..... *A63B 5/11* (2013.01); *A63B 21/0414* (2013.01); *A63B 21/4033* (2015.10)

(58) Field of Classification Search
CPC ..... A63B 5/11; A63B 21/0414
See application file for complete search history.

(56) References Cited

U.S. PATENT DOCUMENTS 2,635,886 A * 4/1953 Schoebel ..... A63G 19/02 280/1.183
3,466,031 A * 9/1969 Boykin, Jr. ..... A63B 5/11 482/27
4,199,136 A * 4/1980 Mansfield ..... A63B 5/08 482/26
5,562,575 A * 10/1996 Gvoich ..... A63B 21/4029 482/52
5,565,003 A * 10/1996 Gerstung ..... A63B 5/08 482/26
7,041,033 B2 * 5/2006 Tom ..... A63B 23/025 601/39
8,668,190 B1 * 3/2014 Heruska ..... A63B 5/11 248/548
2014/0179492 A1 * 6/2014 Wilkins ..... A63B 71/0619 482/27

FOREIGN PATENT DOCUMENTS

CN 210278076 U * 4/2020

* cited by examiner

*Primary Examiner* — William Boddie
(74) *Attorney, Agent, or Firm* — Cozen O'Connor

(57) ABSTRACT

A trampoline includes an elastic plate and a supporting unit, wherein the elastic plate includes a first end and a second end, and a portion, located between the first end and the second end, of the elastic plate is an elastic energy accumulator; the supporting unit includes supporting bodies arranged at the first end and the second end of the elastic plate, and the supporting bodies are capable of supporting the elastic plate and tensioning the first end and the second end of the elastic plate; during bending deformation of the elastic plate, the first end generates a symmetrical turning angle change with respect to the second end; during deformation recovering of the elastic plate, the supporting bodies apply reset force to the first end and the second end by utilizing the potential energy.

10 Claims, 21 Drawing Sheets

TRAMPOLINE AND SPORTS DEVICE

CROSS-REFERENCE TO RELATED APPLICATION

This patent application claims the benefit and priority of Chinese Patent Application No. 202311321877.6 filed with the China National Intellectual Property Administration on Oct. 12, 2023, the disclosure of which is incorporated by reference herein in its entirety as part of the present application.

TECHNICAL FIELD

The present disclosure relates to the technical field of sports equipment and surrounding supporting facilities thereof, in particular to a trampoline and a sports device.

BACKGROUND

The trampoline, as sports and entertainment equipment, is loved by people, especially children and young people. However, the trampoline is too soft to stand firm, is not suitable for middle-aged and elderly people, and occupies a large space.

In the Chinese patent with the publication number of CN102553128A, a spring-supported rigid plate, as a jumping exerciser, is limited by the linear characteristics of compression springs and can affect the sense of sports. In the American patent with the publication number of U.S. Pat. No. 4,199,136A, an elastically bendable semi-rigid plate is used as elastic element. However, the supporting problem of plate end turning angles and plate end distance shortening caused by plate bending cannot be completely solved, so that the fluctuating range of the plate can be limited, and friction noise is generated. Similar to a trampoline structure, in the American patent with the publication number of U.S. Pat. No. 4,037,834A, four-sided tension springs are used to hang plywood. The plywood cannot be bent effectively, and mainly relies on tension springs to store energy, so that the excellent elastic characteristic of bending plate energy storage cannot be achieved.

SUMMARY

The present disclosure aims to provide a trampoline and a sports device. The elastic performance of the trampoline is improved by a bilaterally supported elastic plate. Meanwhile, the problems that the fluctuating amplitude of a thin plate is limited and the friction noise is generated due to turning angles of plate ends generated by bending of a semi-rigid thin plate and distance reduction of plate ends in the prior art are solved.

In order to achieve the purpose, the present disclosure provides the following scheme. The present disclosure provides a trampoline, including:

an elastic plate, wherein the elastic plate comprises a first end and a second end, and a portion, located between the first end and the second end, of the elastic plate is an elastic energy accumulator;

a supporting unit, wherein the supporting unit comprises supporting bodies arranged at the first end and the second end of the elastic plate, and the supporting bodies are capable of supporting the elastic plate and tensioning the first end and the second end of the elastic plate; during bending deformation of the elastic plate, the supporting bodies are subjected to elastic deformation, or ends, connected with the elastic plate, of the supporting bodies rotate and horizontally displace relative to ends, away from the elastic plate, of the supporting bodies to accumulate potential energy, and the first end generates a symmetrical turning angle change with respect to the second end; during deformation recovering of the elastic plate, the supporting bodies apply reset force to the first end and the second end by utilizing the potential energy, so that displacement of the elastic energy accumulator in a horizontal direction is limited during the bending deformation and deformation recovering of the elastic plate.

In some embodiments, the supporting body is an elastomer.

The supporting body is of an integrated inflatable structure, locating holes are formed in the first end and the second end of the elastic plate, the supporting body is provided with an upper fixed part and a lower fixed part, the upper fixed part communicates with the lower fixed part through a connecting part, and the connecting part can pass through a corresponding locating hole; when the supporting body is in an uninflated state, after the upper fixed part and the connecting part pass through the corresponding locating hole, the supporting body is inflated, cross-sectional areas of the upper fixed part and the lower fixed part after inflated are larger than that of the corresponding locating hole, the upper fixed part and the lower fixed part are matched with each other to fix the elastic plate, and the supporting body is made of flexible material.

Alternatively, the supporting body is made of closed-cell polymeric foam material, an upper part of the supporting body is connected with the elastic plate, and transverse cross-sectional area of the supporting body is gradually increased from top to bottom along a vertical direction.

Alternatively, a bottom surface of the supporting body corresponding to the first end and a bottom surface of the supporting body corresponding to the second end are connected by flexible material.

In some embodiments, the supporting body includes a support frame and a connector. The bottoms of the first end and the second end of the elastic plate are both connected with plate end supports. The support frame is connected with a corresponding plate end support by the connector.

The connector is a hinged connector. The support frame is hinged to the corresponding plate end support by the connector, and a bottom of the support frame is provided with an elastic bottom pad or a plurality of elastic legs; when the bottom of the support frame is provided with the plurality of elastic legs, and the plurality of elastic legs are arranged along a direction of a connecting line of the first end and the second end of the elastic plate.

Alternatively, the connector is an elastic connector, and the connector is made of elastic material; the support frame is of a split structure, and comprises a first frame body and a second frame body arranged along a vertical direction, the first frame body is connected with the corresponding plate end support by the connector, the second frame body is located at a bottom of the first frame body, and the first frame body and the second frame body are connected by a plurality of elastic elements; the plurality of elastic elements each are in a shape of cylinder, and the plurality of elastic elements are arranged in a form of a tower.

In some embodiments, the supporting body includes a roller. The bottoms of the first end and the second end of the elastic plate are both connected with plate end supports. The roller is rotatably connected with a corresponding plate end support. An axis of the roller is perpendicular to a connecting line of the first end and the second end of the elastic plate.

The supporting body also includes a roller support. A rolling groove matched with the roller is formed in the roller support. The roller is rotatably arranged in the rolling groove and s movable horizontally in the rolling groove, and elastic buffer material is internally provided inside the rolling groove, or, a bottom of the roller support is provided with a base mat.

Alternatively, the supporting body also includes a restraint bottom plate, and the restraint bottom plate is arranged at the bottom of the roller.

A restraint elastic member is arranged between the roller and the plate end support, between the restraint bottom plate and the roller, or between two adjacent rollers along the direction from the first end to the second end of the elastic plate to apply reset force to the roller.

In some embodiments, the restraint elastic member is a spring, and the roller is connected with the roller support or the restraint bottom plate by the restraint elastic member.

Alternatively, the restraint elastic member is an elastic belt, the restraint elastic member is in the shape of a pattern 8, and the restraint elastic member sleeves two adjacent rollers.

In some embodiments, the bottom of the elastic plate is provided with a stop supporting element, and the stop supporting element is located at the symmetric center of the elastic plate.

The stop supporting element includes a stop supporting table, and the stop supporting table is made of elastic material.

Alternatively, the stop supporting element includes elastic arms and guide wheels. First ends of the elastic arms are hinged to the elastic plate, second ends of the elastic arms are rotatably connected with the guide wheels, a number of the elastic arms is two, two elastic arms are symmetrically arranged, each of the elastic arms is connected with at least one guide wheel, and the two elastic arms are connected by a connecting element made of elastic material.

Alternatively, the stop supporting element includes two cambered plates symmetrically arranged along the vertical direction, and the two cambered plates are hinged and connected at ends to form a ring.

The bottoms of the stop supporting table and the cambered plate away from the elastic plate are both provided with vacuum suction cups or cushion pads.

In some embodiments, the thickness of the elastic plate is thick at the middle, and decreases gradually along directions from a center of the elastic plate towards the first end and the second end.

Alternatively, the elastic plate is of a composite multilayer structure.

Alternatively, the elastic plate is provided with longitudinal reinforcing ribs or a reinforcing plate, and the reinforcing plate is arranged in the middle of the elastic plate.

Alternatively, the bottom of the elastic plate is provided with a traction reinforcing member.

Alternatively, the top of the elastic plate is provided with a buffer structure layer.

Alternatively, both ends of the elastic plate are provided with surface plates in which a trapezoidal notch is formed.

In some embodiments, the number of the supporting bodies, connected with the first end and the second end, of the elastic plate is at least two, and connecting positions of the first end and the second end of the elastic plate with the supporting bodies can be adjusted.

The elastic plate is connected with the supporting bodies via bolts, and the connecting positions can be adjusted.

Alternatively, the elastic plate is provided with connecting pins. Connecting slots matched with the connecting pins are formed in the supporting body. The connecting pin is rotatably arranged in the connecting slot. The number of the connecting slots is, and the connecting slots are arranged along the direction of the connecting line of the first end and the second end of the elastic plate.

In some embodiments, the projection of the elastic plate on the horizontal plane is rectangular. The length-width ratio of the elastic plate is between 1 and 10. The first end and the second end of the elastic plate are arranged along the length direction of the elastic plate. The thickness of the elastic plate is less than one fiftieth of the width of the elastic plate. The elastic plate is made of composite material or metal material.

One or several of an armrest, a stool, a chair, a saddle and a bed guard are installed on the elastic plate.

The elastic plate is provided with an electronic counter or a vibration sensor so as to monitor the times of fluctuating movement of the elastic plate.

The present disclosure also provides a sports device. The sports device includes a follow-up bed frame or an overlapping plate, and the trampoline. The number of the trampolines is multiple. The trampolines are arranged at the bottom of the follow-up bed frame or the overlapping plate.

Compared with the prior art, the present disclosure has the following technical effects.

The present disclosure provides a trampoline. The trampoline includes an elastic plate and a supporting unit. The elastic plate includes a first end and a second end, and a portion, located between the first end and the second end, of the elastic plate is an elastic energy accumulator. The supporting unit includes supporting bodies arranged at the first end and the second end of the elastic plate, and the supporting bodies are capable of supporting the elastic plate and tensioning the first end and the second end of the elastic plate. During the bending deformation of the elastic plate, the supporting bodies are subjected to elastic deformation, or ends, connected with the elastic plate, of the supporting bodies rotate and horizontally displace relative to ends, away from the elastic plate, of the supporting bodies to accumulate potential energy, and the first end generates a symmetrical turning angle change with respect to the second end. During the deformation recovering of the elastic plate, the supporting bodies apply reset force to the first end and the second end by utilizing the potential energy, so that the displacement of the elastic energy accumulator in the horizontal direction is limited during the bending deformation and deformation recovering of the elastic plate.

According to the trampoline in the present disclosure, the elastic plate and the supporting bodies capable of accumulating potential energy are used for supporting the elastic plate so as to enhance the elastic performance of the trampoline. During the bending deformation of the elastic plate, the first end and the second end of the elastic plate generate symmetrical turning angle changes, and the supporting bodies are subjected to elastic deformation along with the elastic plate, or, the ends, connected with the elastic plate, of the supporting bodies rotate and horizontally displace relative to the ends, away from the elastic plate, of the supporting body to accumulate potential energy. During the deformation recovering of the elastic plate, the supporting bodies apply reset force to the first end and the second end of the elastic plate by utilizing elastic force or the accumulated potential energy, so that the trampoline in the present disclosure can adapt to and overcome the adverse effects of the turning angles at both ends of the elastic plate and the change of the horizontal distance between both ends of the elastic plate due to the bending of the elastic plate on bilateral support. The vertical fluctuating movement of the bilaterally supported elastic plate can be realized, so that the fluctuating amplitude of the elastic plate is increased, the friction noise generated in the fluctuating process is avoided, and obvious horizontal displacement generated in the middle of the elastic plate is avoided, thereby improving the stability of the trampoline in use, facilitating for entertainment, body building and rehabilitation exercise of people of different age groups, and using as a springboard.

The embodiment provides a sports device. The sports device includes a follow-up bed frame or an overlapping plate, and the trampoline. The number of the trampolines is multiple. The trampolines are arranged at the bottom of the follow-up bed frame or the overlapping plate so as to support the follow-up bed frame or the overlapping plate. The sports device is constructed according to requirements, so that the adaptability of the trampoline is promoted.

BRIEF DESCRIPTION OF THE DRAWINGS

To more clearly illustrate the present embodiment of the present disclosure or the technical scheme in the prior art, the following briefly introduces the attached figures to be used in the present embodiment. Apparently, the attached figures in the following description show merely some embodiments of the present disclosure, and those skilled in the art may still derive other drawings from these attached figures without creative efforts.

REFERENCE SIGNS

Figure 1:
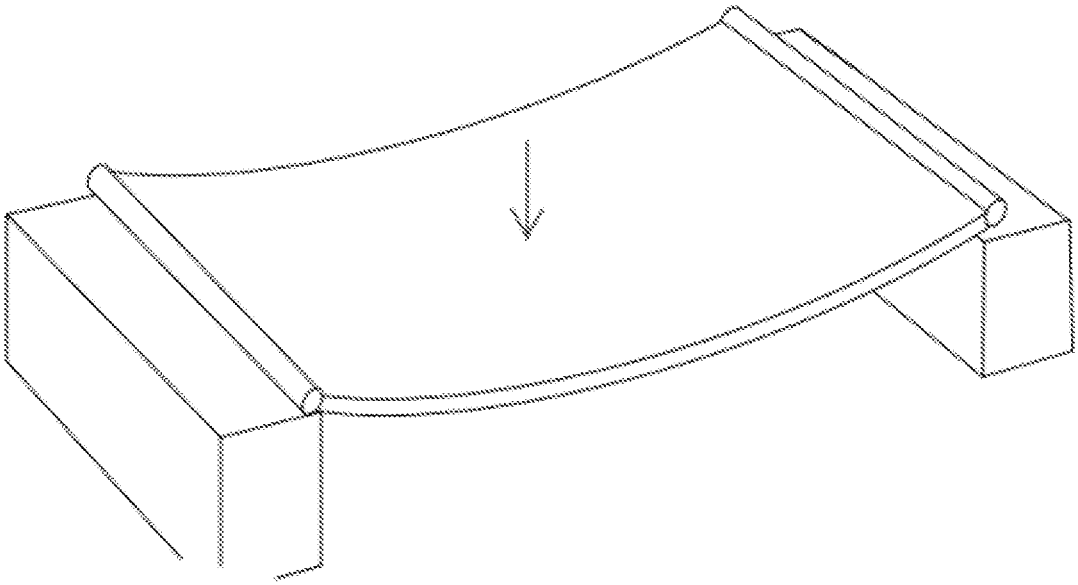
FIG. 1 is a schematic diagram of the deformation of a rectangular elastic plate when it is supported at both ends and is subjected to a downward force in the middle.
Figure 2:
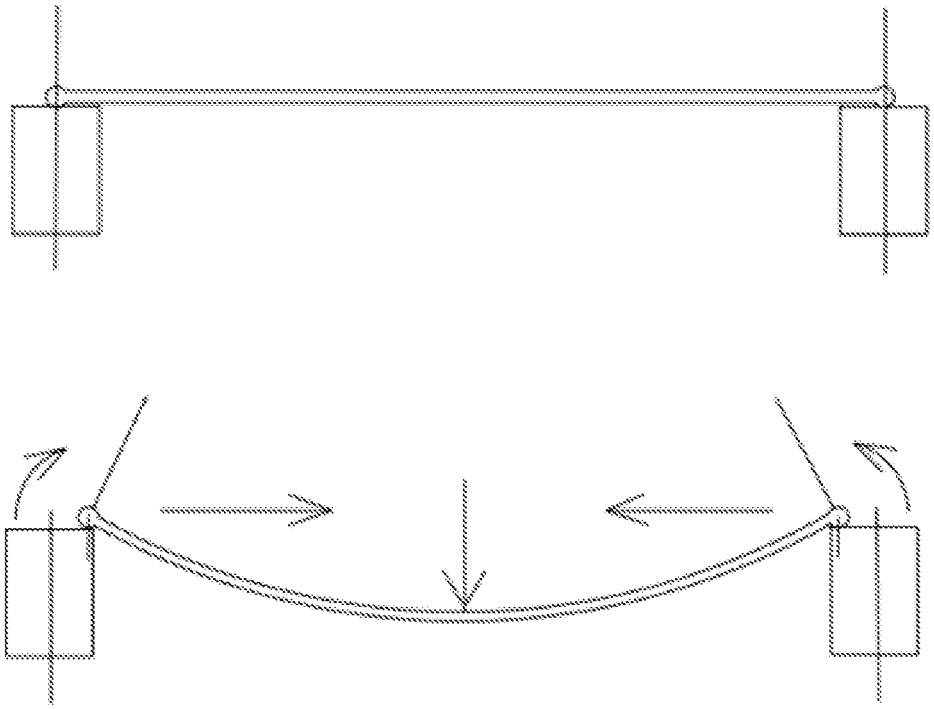
FIG. 2 is a schematic diagram of the deformation of a rectangular elastic plate when it is supported at both ends and is subjected to a downward force in the middle.
Figure 3:
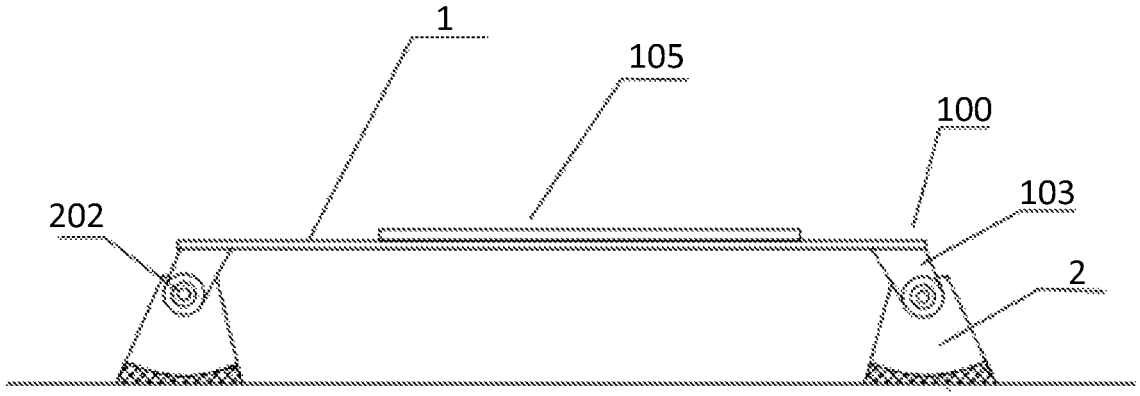
FIG. 3 is a structural schematic diagram of a trampoline disclosed in an embodiment of the present disclosure.
Figure 4:
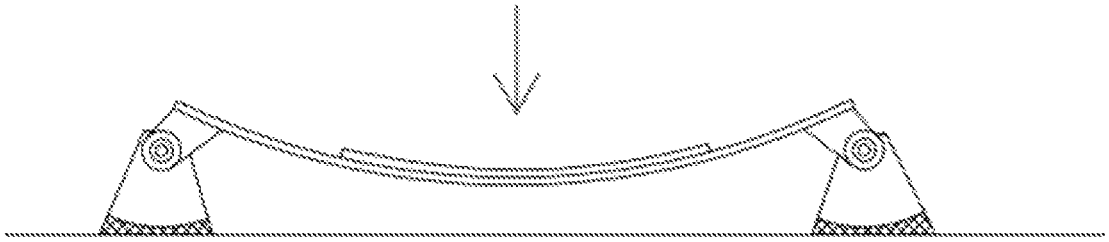
FIG. 4 is a schematic diagram of a trampoline in FIG. 3 when pressed.

100, trampoline;

1, elastic plate; 101, first end; 102, second end; 103, plate end support; 104, traction reinforcing member; 105, buffer structure layer; 106, connecting pin;

2, support; 201, support frame; 202, connector; 203, elastic bottom pad; 204, elastic leg; 205, elastic element; 206, roller; 207, roller support; 208, elastic buffer material; 209, restraint elastic member; 210, restraint bottom plate; 211, stop supporting element; 212, vacuum suction cup; 213, elastic arm; 214, guide wheel; 215, connecting element; 216, cambered plate; and 217, connecting slot;

3, armrest; and

4, saddle.

DETAILED DESCRIPTION OF THE EMBODIMENTS

The following clearly and completely describes the technical scheme in the embodiments of the present disclosure with reference to the embodiments of the present disclosure. Apparently, the described embodiments are merely a part rather than all of the embodiments of the present disclosure. Based on the embodiment in the present disclosure, all other embodiments acquired by the ordinary technical staff in the art under the premise of without contributing creative labor belong to the scope protected by the present disclosure.

The present disclosure aims to provide a trampoline and a sports device. The elastic performance of the trampoline is improved by a bilaterally supported elastic plate. Meanwhile, the problems that the fluctuating amplitude of a thin plate is limited and the friction noise is generated due to turning angles of plate ends generated by bending of a semi-rigid thin plate and distance reduction of plate ends in the prior art are solved.

To make the foregoing objective, features and advantages of the present disclosure clearer and more comprehensible, the present disclosure is further described in detail below with reference to the attached figures and specific embodiments.

The present disclosure provides a trampoline 100. The trampoline 100 includes an elastic plate 1 and a supporting unit. The elastic plate 1 includes a first end 101 and a second end 102, and a portion, located between the first end 101 and the second end 102, of the elastic plate 1 is an elastic energy accumulator. The supporting unit includes supporting bodies 2 arranged at the first end 101 and the second end 102 of the elastic plate 1, and the supporting bodies 2 are capable of supporting the elastic plate 1 and tensioning the first end 101 and the second end 102 of the elastic plate 1. During the bending deformation of the elastic plate 1, the supporting bodies 2 are subjected to elastic deformation, or ends, connected with the elastic plate 1, of the supporting bodies 2 rotate and horizontally displace relative to ends, away from the elastic plate 1, of the supporting bodies 1 to accumulate potential energy, and the first end 101 and the second end 102 generate symmetrical turning angle changes. During the deformation recovering of the elastic plate 1, the supporting bodies 2 apply reset force to the first end 101 and the second end 102 by utilizing the potential energy, so that the displacement of the elastic energy accumulator in a horizontal direction is limited during the bending deformation and deformation recovering of the elastic plate 1.

According to the trampoline in the present disclosure, the elastic plate 1 and the supporting bodies 2 capable of accumulating potential energy are used for supporting the elastic plate 1 so as to enhance the elastic performance of the trampoline 100. During the bending deformation of the elastic plate 1, the first end 101 and the second end 102 of the elastic plate 1 generate symmetrical turning angle changes, and the supporting bodies 2 are subjected to elastic deformation along with the elastic plate 1. Additionally or alternatively, the ends, connected with the elastic plate 1, of the supporting bodies 2 rotate and horizontally displace relative to the ends, away from the elastic plate 1, of the supporting bodies 2 to accumulate potential energy. During the deformation recovering of the elastic plate 1, the supporting bodies 2 apply reset force to the first end 101 and the second end 102 of the elastic plate 1 by utilizing elastic force or the accumulated potential energy within the supporting bodies 2, so that the trampoline 100 in the present disclosure can adapt to and overcome the adverse effects of the turning angles at both ends of the elastic plate 1 and the change of the horizontal distance between both ends of the elastic plate 1 due to the bending of the elastic plate 1 on bilateral support. The vertical fluctuating movement of the bilaterally supported elastic plate 1 can be realized, so that the fluctuating amplitude of the elastic plate 1 is increased, the friction noise generated in the fluctuating process is avoided, and obvious horizontal displacement generated in the middle of the elastic plate 1 is avoided, thereby improving the stability of the trampoline 100 in use, facilitating for entertainment, body building and rehabilitation exercise of people of different age groups, and using as a springboard.

The trampoline 100 in the present disclosure is further explained through the following specific embodiments.

Embodiment I

In the embodiment, each supporting body 2 is an elastomer.

Figure 7:
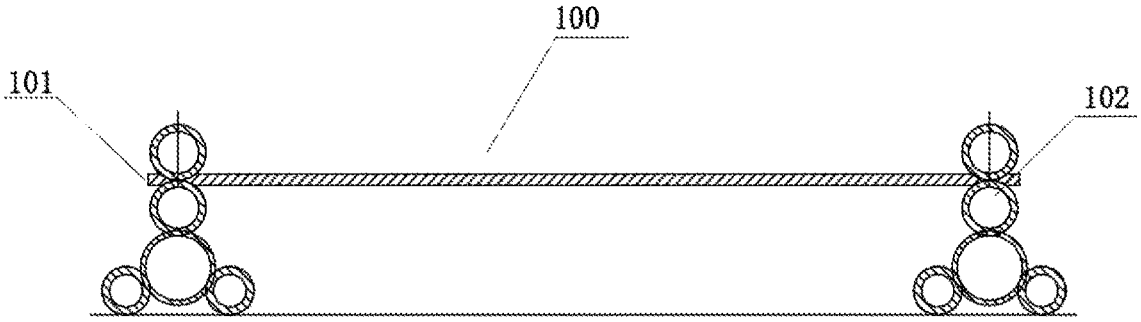
FIG. 7 is a structural schematic diagram of a trampoline disclosed in a first embodiment of the present disclosure.
Figure 8:
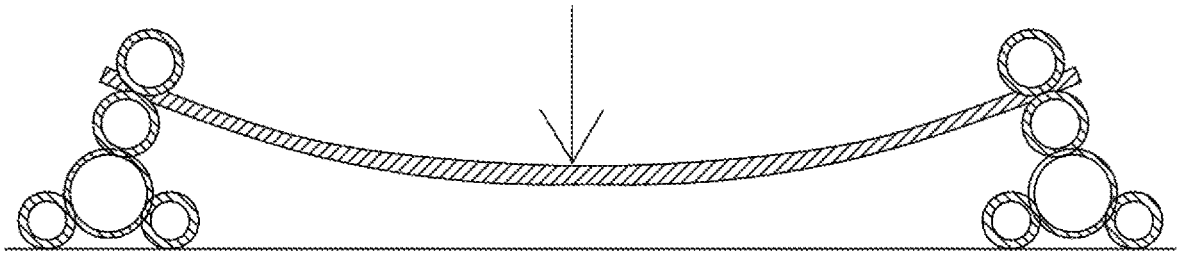
FIG. 8 is a schematic diagram of a trampoline in FIG. 7 when pressed.
Figure 9:
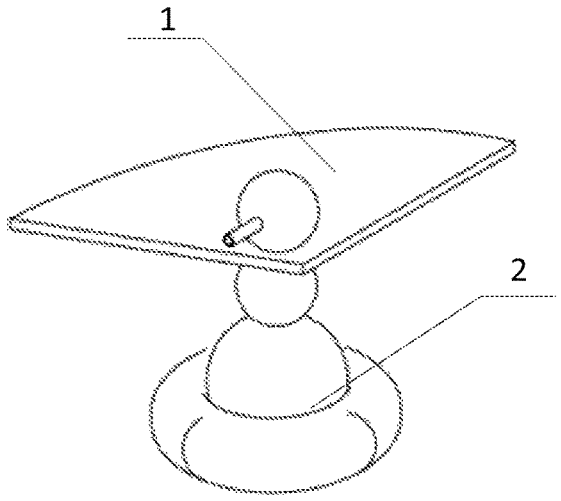
FIG. 9 is a partial structural schematic diagram of a trampoline in FIG. 7.

The supporting body 2 is of an integrated inflatable structure, as shown in FIG. 7. Locating holes are formed in the first end 101 and the second end 102 of the elastic plate 1. The supporting body 2 is provided with an upper fixed part and a lower fixed part. The upper fixed part communicates with the lower fixed part through a connecting part.

The connecting part can pass through a corresponding locating hole. When the supporting body 2 is in an uninflated state, the supporting body 2 can pass through the corresponding locating hole. After the upper fixed part and the connecting part pass through the corresponding locating hole, the supporting body 2 is inflated. The inflated supporting body 2 is an elastomer. The cross-sectional areas of the upper fixed part and the lower fixed part after inflated are larger than that of the corresponding locating hole. The upper fixed part and the lower fixed part are matched with each other to fix the elastic plate 1. The supporting body 2 is made of flexible material. When the elastic plate 1 generates bending deformation under pressure, the supporting body 2 correspondingly is subjected to elastic deformation, and the first end 101 and the second end 102 of the elastic plate 1 generate symmetrical turning angle changes. During the deformation recovering of the elastic plate 1, the supporting bodies 2 apply reset force to the first end 101 and the second end 102 by elastic force. In practical application, the supporting bodies 2 can also be fixed by directly connecting with the elastic plate 1 to further improve the structural integrity and stability of the trampoline 100.

Figure 10:
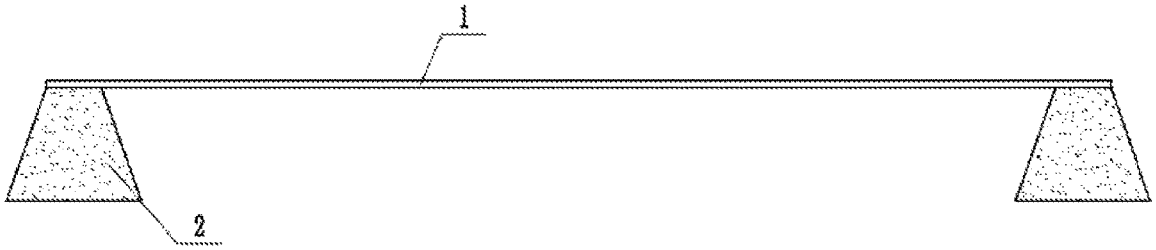
FIG. 10 another structural schematic diagram of a trampoline disclosed in the first embodiment of the present disclosure.
Figure 11:
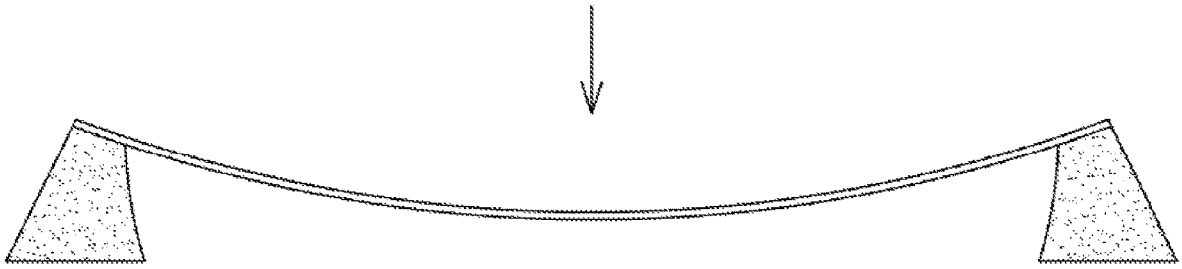
FIG. 11 is a schematic diagram of a trampoline in FIG. 10 when pressed.

Alternatively, the supporting body 2 is made of closed-cell polymeric foam material. An upper part of the supporting body 2 is connected with the elastic plate 1, and a lower part of the supporting body 2 can make contact with the ground or the setting position of the trampoline 100, as shown in FIG. 10. When the elastic plate 1 is subjected to bending deformation under pressure, the supporting body 2 made of elastic material generates elastic deformation to adapt to the turning angle changes of the first end 101 and the second end 102 of the elastic plate 1. It should be noted that the transverse cross-sectional area of the supporting body 2 is gradually increased from top to bottom along the vertical direction, so as to enhance the supporting effect of the supporting body 2 on the elastic plate 1 and improve the structural stability of the trampoline 100. In practical application, the supporting body 2 can be of a cylindrical structure, a prismatic structure with a trapezoidal longitudinal cross section or other structures with irregular cross sections. In addition, other elastic material can be selected according to specific working conditions to meet different requirements of use.

Embodiment II

Figure 5:
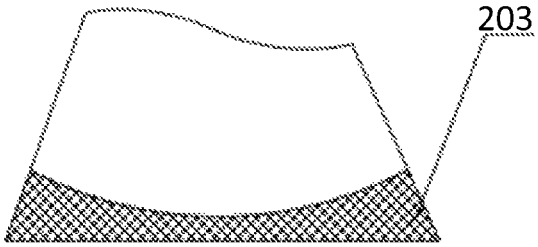
FIG. 5 is a partial structural schematic diagram of a trampoline in FIG. 3.
Figure 6:
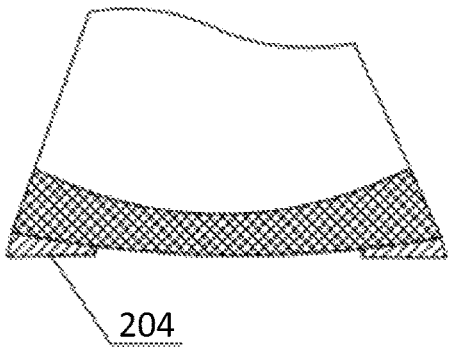
FIG. 6 is a structural schematic diagram of a support frame of a trampoline disclosed in an embodiment of the present disclosure.

Each supporting body 2 includes a support frame 201 and a connector 202. The bottoms of the first end 101 and the second end 102 of the elastic plate 1 are both connected with plate end supports 103. The support frame 201 is connected with a corresponding plate end support 103 by the connector 202, wherein the connector 202 is a hinged connector. The support frame 201 is hinged to the corresponding plate end support 103 by the connector 202, so that the elastic plate 1 cannot make contact with the ground when generating bending deformation. Under the effect of the hinged connector, the support frame 201 can rotate relative to the elastic plate 1. In addition, the bottom of the support frame 201 is provided with an elastic bottom pad 203 or elastic legs 204, as shown in FIG. 5 and FIG. 6, so that the support frame 201 can horizontally displace relative to the elastic plate 1 while rotated relative to the elastic plate 1, and the supporting bodies 2 accumulate elastic potential energy generated by compression of the elastic bottom pad 203 or the elastic legs 204 to apply reset force to the first end 101 and the second end 102 of the elastic plate 1.

In practical application, the elastic bottom pad 203 or the elastic legs 204 can be selected according to actual situations so as to improve the flexibility and adaptability of the device. When the bottom of the support frame 201 is provided with the elastic legs 204, the number of the elastic legs 204 is multiple, and the elastic legs 204 are arranged along the direction of a connecting line of the first end 101 and the second end 102 of the elastic plate 1. When the supporting bodies 2 tends to swing laterally along with the bending deformation of the elastic plate 1, the swing resistance is increased, so that the middle of the elastic plate 1 does not significantly displace horizontally and is also beneficial for automatic reset after swinging.

It should also be noted that in the embodiment, the longitudinal cross section of the support frame 201 is trapezoidal so as to enhance the structural stability of the trampoline 100. In practical application, other shapes, such as a cylinder and a conical frustum can be adopted.

Embodiment III

Figure 12:
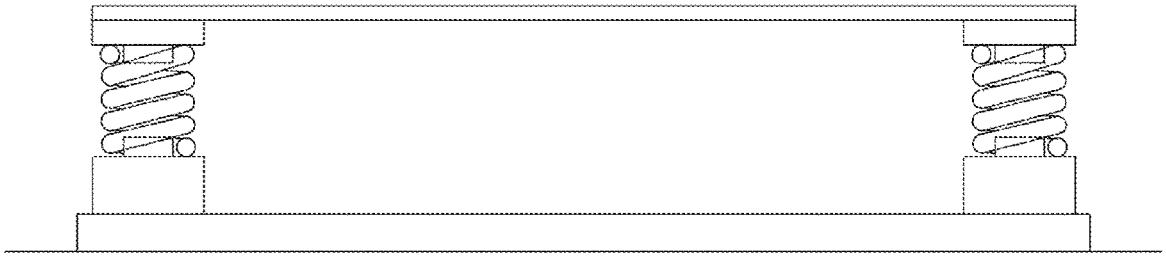
FIG. 12 is a structural schematic diagram of a trampoline disclosed in a third embodiment of the present disclosure.
Figure 13:
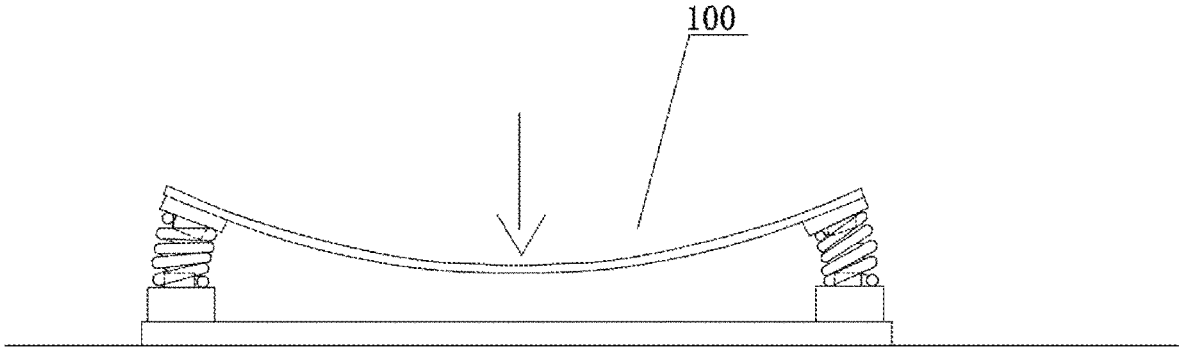
FIG. 13 is a schematic diagram of a trampoline in FIG. 12 when pressed.
Figure 14:
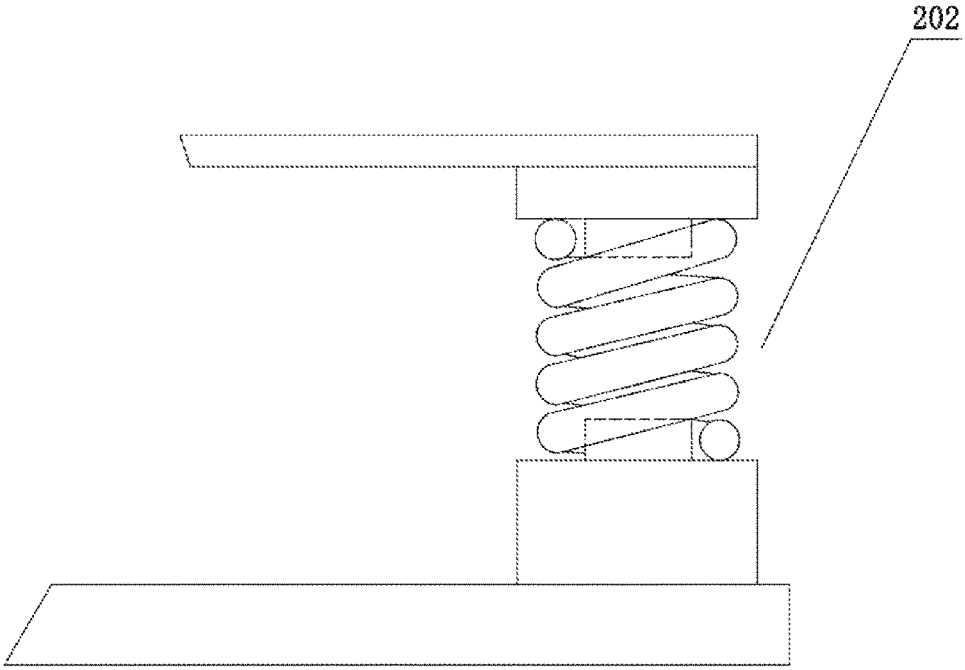
FIG. 14 is a partial structural schematic diagram of a trampoline in FIG. 12.

In the embodiment, each supporting body 2 includes a support frame 201 and a connector 202. The bottoms of the first end 101 and the second end 102 of the elastic plate 1 are both connected with plate end supports 103, and the support frame 201 is connected with a corresponding plate end support 103 by the connector 202, wherein the connector 202 is an elastic connector 202, and the connector 202 is made of elastic material, as shown in FIG. 12. In practical application, the connector 202 can be a spring or made of other elastic material. When the elastic plate 1 is bent under pressure, the connector 202 is subjected to bending deformation so as to adapt to the changes of the horizontal distance between the plate ends and apply reset force to the plate ends in the rebounding process of the elastic plate 1. It needs to be explained herein that the "plate ends" refer to the first end 101 and the second end 102 of the elastic plate 1.

Figure 15:
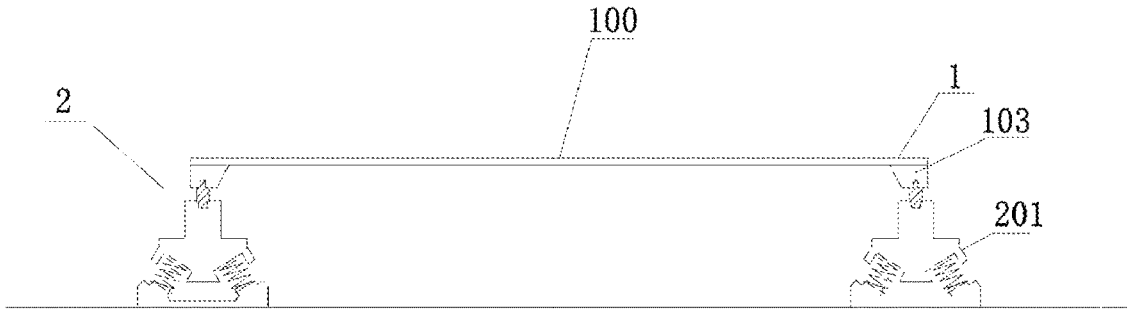
FIG. 15 is another structural schematic diagram of a trampoline disclosed in the third embodiment of the present disclosure.
Figure 16:
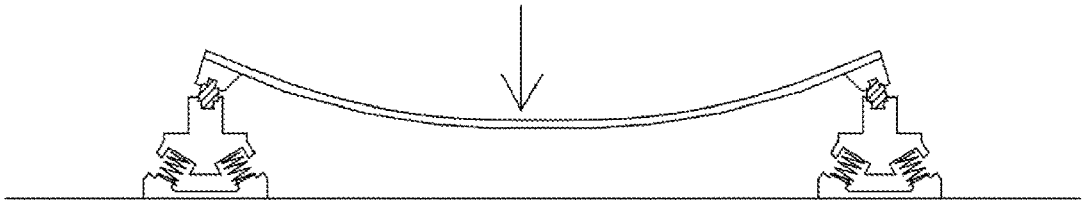
FIG. 16 is a schematic diagram of a trampoline in FIG. 15 when pressed.
Figure 17:
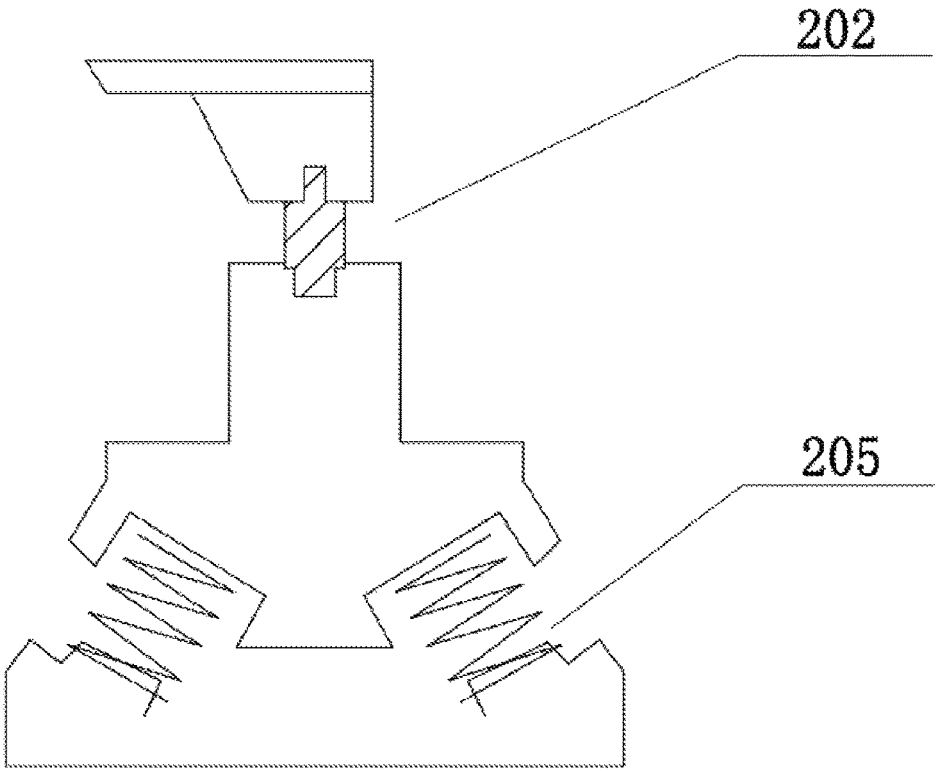
FIG. 17 is a partial structural schematic diagram of a trampoline in FIG. 15.

In practical application, the support frame 201 may also be of a split structure, as shown in FIG. 15. The support frame 201 includes a first frame body and a second frame body arranged along the vertical direction. The first frame body is connected with the corresponding plate end support 103 by the connector 202, the second frame body is located at the bottom of the first frame body, and the first frame body and the second frame body are connected by elastic elements 205. The elastic element is in a shape of cylinder, or the number of the elastic elements 205 is multiple, and the elastic elements 205 are arranged in the form of a tower. The support frame 201 is set to be of a split structure, and includes a first frame and a second frame, and elastic elements 205 are additionally arranged between the first frame and the second frame. When the elastic plate 1 is bent under pressure and the supporting body 2 tends to swing laterally, the elastic element 205 at a side away from the center of the elastic plate is stretched, and the swing resistance can also be increased, so that the middle of the elastic plate 1 does not significantly displace horizontally In the bending process of the elastic plate 1, the adaptability of the supporting bodies 2 to the change of the plate ends of the elastic plate 1 is further enhanced, and the capacity of the supporting bodies 2 for accumulating elastic potential energy is enhanced.

It should be noted that the elastic elements 205 may be made of a metal spring or a polymer elastomer or filled gas to so as to improve the flexibility and adaptability of the supporting bodies 2.

Embodiment IV

Figure 18:
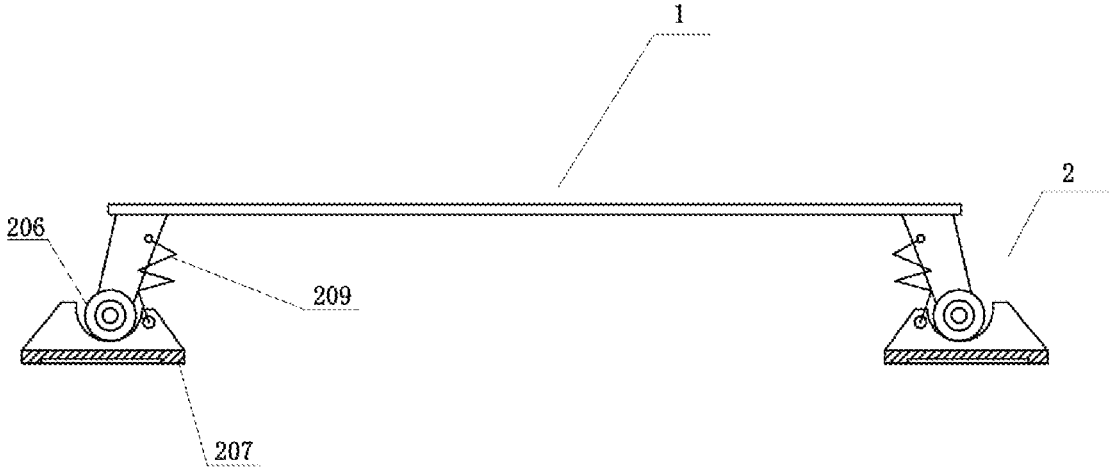
FIG. 18 is a structural schematic diagram of a trampoline in a fourth embodiment of the present disclosure.
Figure 19:
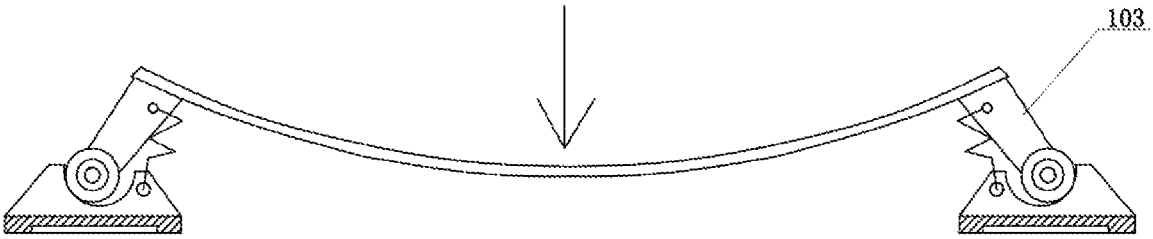
FIG. 19 is a schematic diagram of a trampoline in FIG. 18 when pressed.
Figure 20:
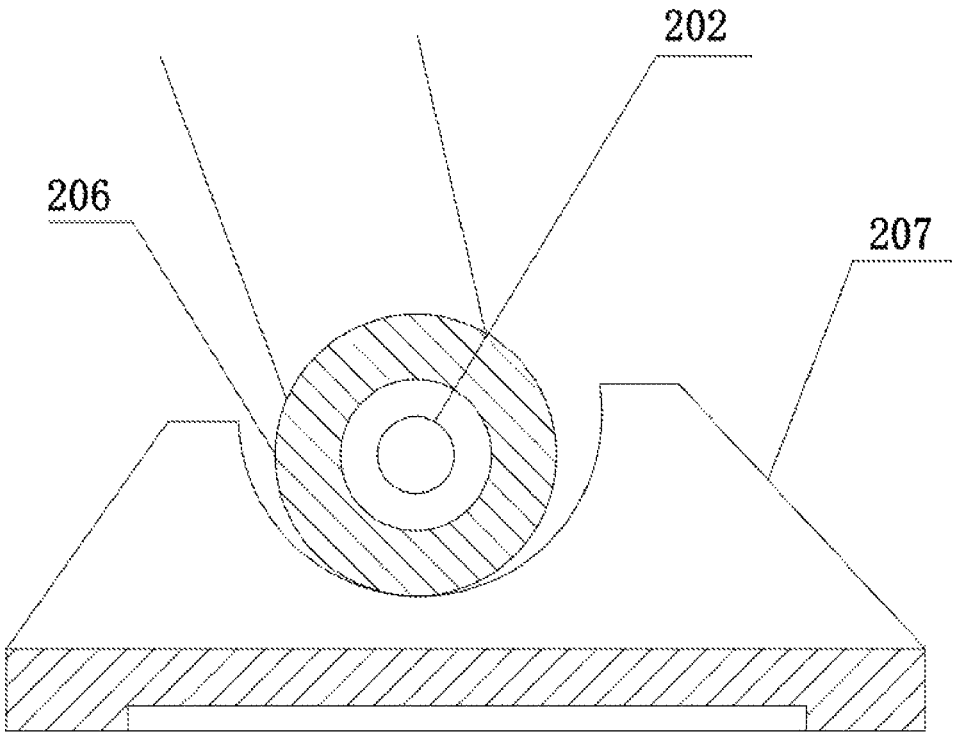
FIG. 20 is a first partial structural schematic diagram of a trampoline in FIG. 18.
Figure 21:
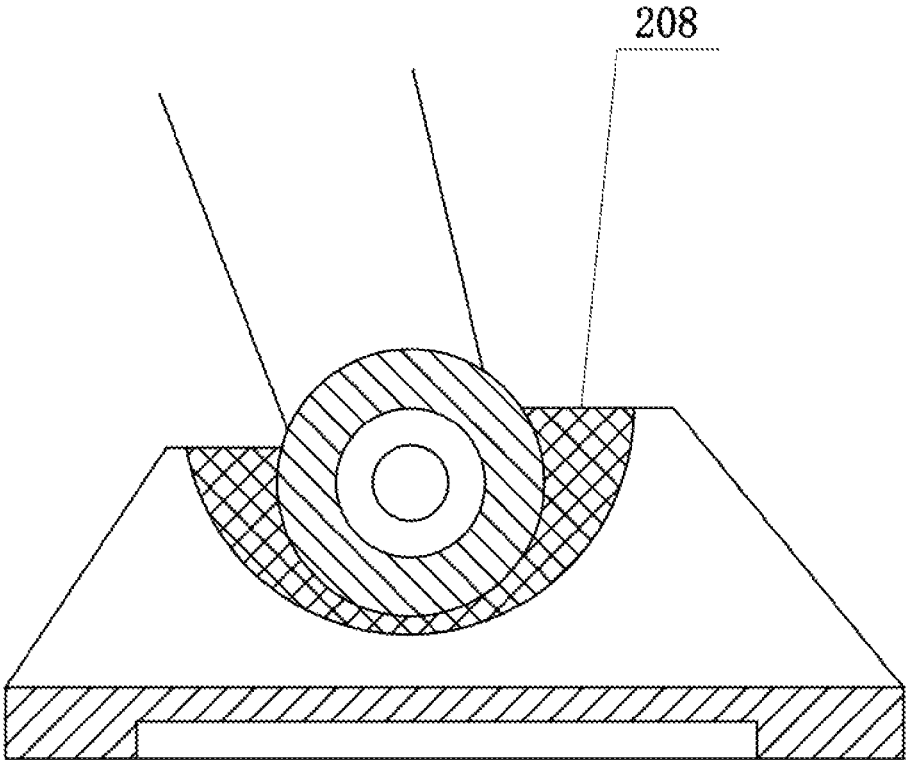
FIG. 21 is a second partial structural schematic diagram of a trampoline in FIG. 18.
Figure 22:
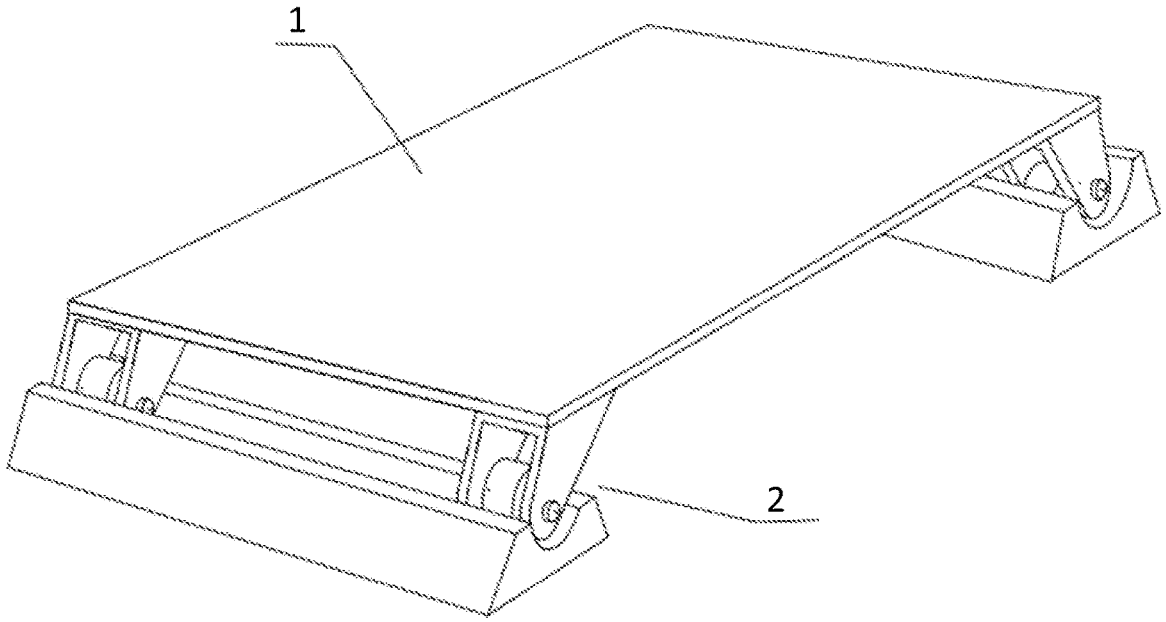
FIG. 22 is an axonometric schematic diagram of a trampoline in the fourth embodiment of the present disclosure.
Figure 23:
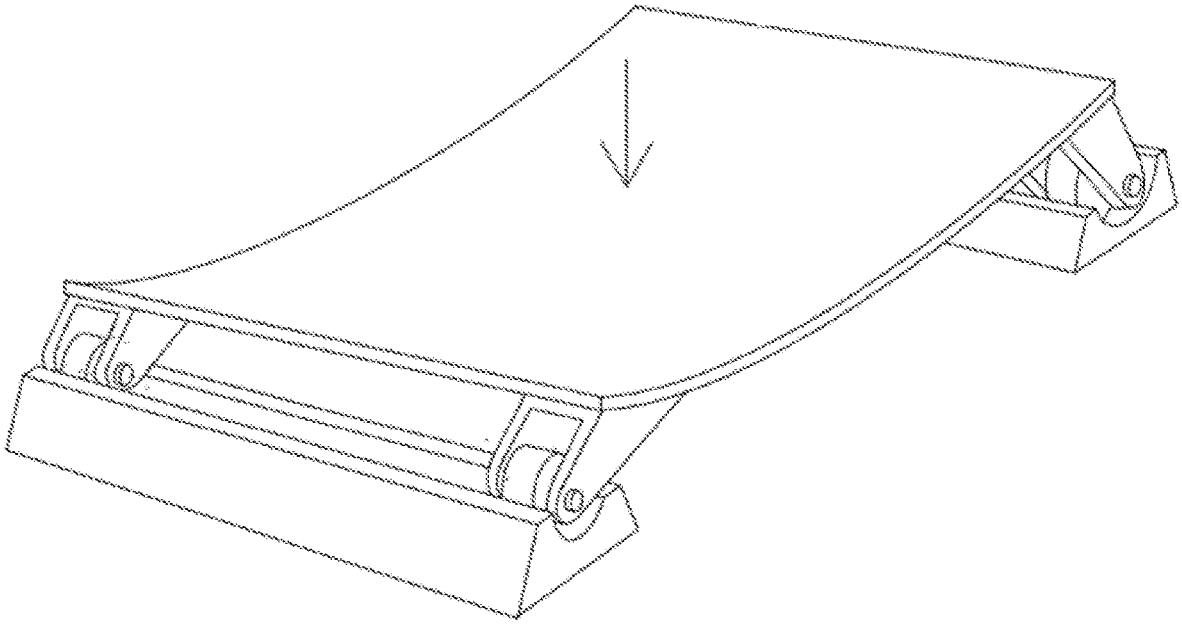
FIG. 23 is a schematic diagram of a trampoline in FIG. 22 when pressed.

In the embodiment, each supporting body 2 includes a roller 206 and a roller support 207, as shown in FIG. 18 and FIG. 22. The bottoms of the first end 101 and the second end 102 of the elastic plate 1 are both connected with plate end supports 103. The roller 206 is rotatably connected with a corresponding plate end support 103. An axis of the roller 206 is perpendicular to a connecting line of the first end 101 and the second end 102 of the elastic plate 1. A rolling groove matched with the roller 206 is formed in the roller support 207. The roller 206 is rotatably arranged in the rolling groove, and is movable horizontally in the rolling groove. In the deformation process of the elastic plate 1 under pressure, the roller 206 rolls laterally, namely the roller 206 rolls in the rolling groove and displaces horizontally. The rolling directions of the rollers 206 located at the first end 101 and the second end 102 of the elastic plate 1 are opposite so as to adapt to the change of the distance between plate ends. Meanwhile, the central position of the roller 206 rises, and the roll resistance is increased. The rolling groove limits the lateral rolling distance of the roller 206 to ensure that the middle of the elastic plate 1 does not significantly displace horizontally. After the pressure is eliminated and the deformation of the elastic plate 1 is recovered, the roller 206 is reset under the effect of gravitational potential energy thereof. The roller support 207 can be made of metal, polymer material or composite material.

It also needs to be noted that elastic buffer material 208 can be additionally arranged in the rolling groove, or, the bottom of the roller support 207 is provided with a base mat, and the base mat is also made of elastic material, so that the supporting body 2 adapts to the bending deformation of the elastic plate 1, and thus the middle of the elastic plate 1 does not significantly displace horizontally.

When the elastic buffer material 208 is arranged in the rolling groove, the height of the rolling groove is required to be reasonably set to prevent the roller 206 from slipping out of the rolling groove. Reasonable setting of the size of the rolling groove according to a rolling track of the roller 206 is a conventional means for those skilled in the art and will not be described here. In addition, a limit structure can be arranged in the rolling groove, or a limit cover can be additionally installed at an opening of the rolling groove, so as to limit the extreme movement position of the roller 206 and improve the working reliability of the supporting body 2.

When the first end 101 and the second end 102 of the elastic plate 1 each are provided with two rollers 206, the roller support 207 located at one end of the elastic plate 1 can be set to be of an integral structure. In addition, the roller support 207 can be made of elastic material, so that the roller support 207 has the capability of bending deformation to further enhance the elastic characteristics of the whole device. Vertical up-and-down movement can be realized at the middle of the elastic plate 1 by using the elastic bending deformation of the elastic plate 1.

Embodiment V

Figure 24:
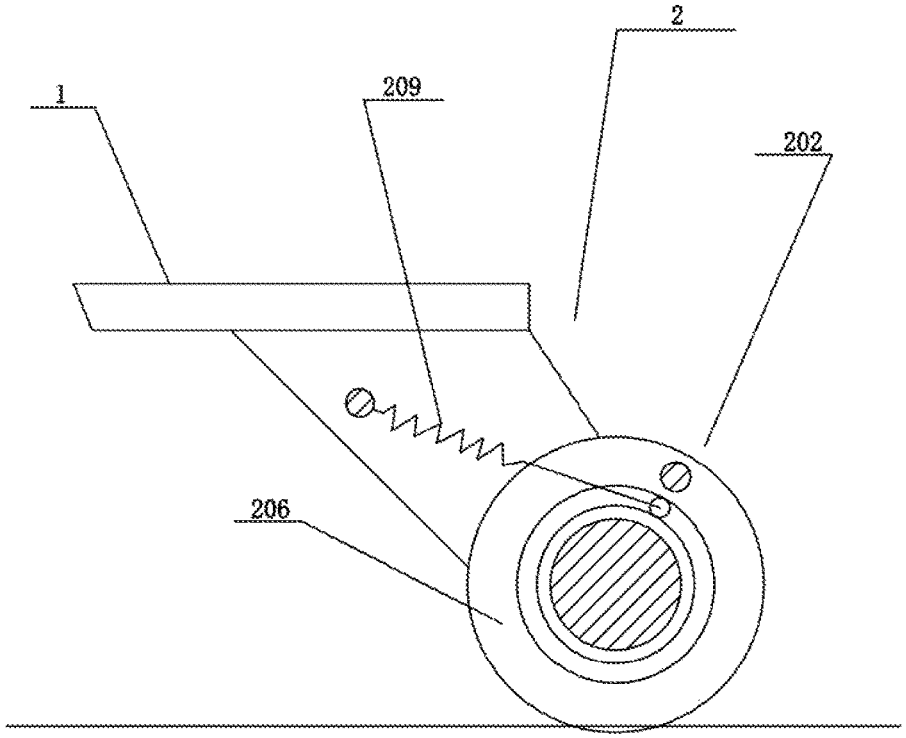
FIG. 24 is a partial schematic diagram of a trampoline in a fifth embodiment of the present disclosure.

In the embodiment, each supporting body 2 includes a roller 206. The bottoms of the first end 101 and the second end 102 of the elastic plate 1 are both connected with plate end supports 103. The roller 206 is rotatably connected with a corresponding plate end support 103. An axis of the roller 206 is perpendicular to a connecting line of the first end 101 and the second end 102 of the elastic plate 1. A restraint elastic member 209 is arranged between the roller 206 and the plate end support 103, as shown in FIG. 24. The restraint elastic members 209 at both ends of the elastic plate 1 are symmetrically arranged, and a connecting point of the restraint elastic member 209 and the roller 206 is not on a rotating axis of the roller 206. When the elastic plate 1 is bent and deformed downward under pressure, the roller 206 rotates and pulls the restraint elastic member 209 and is reset under the elastic force of the restraint elastic member 209, so that the middle of the elastic plate 1 does not significantly displace horizontally. The restraint elastic member 209 may be selected from a tension spring or a torsion spring and so on, and is low in cost and convenient for maintenance and replacement.

Figure 25:
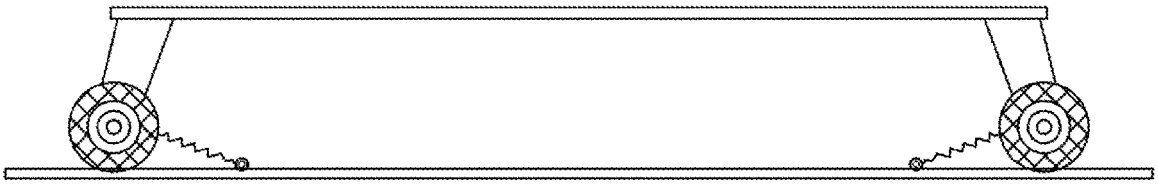
FIG. 25 is a structural schematic diagram of a trampoline of another structure in the fifth embodiment of the present disclosure.
Figure 26:
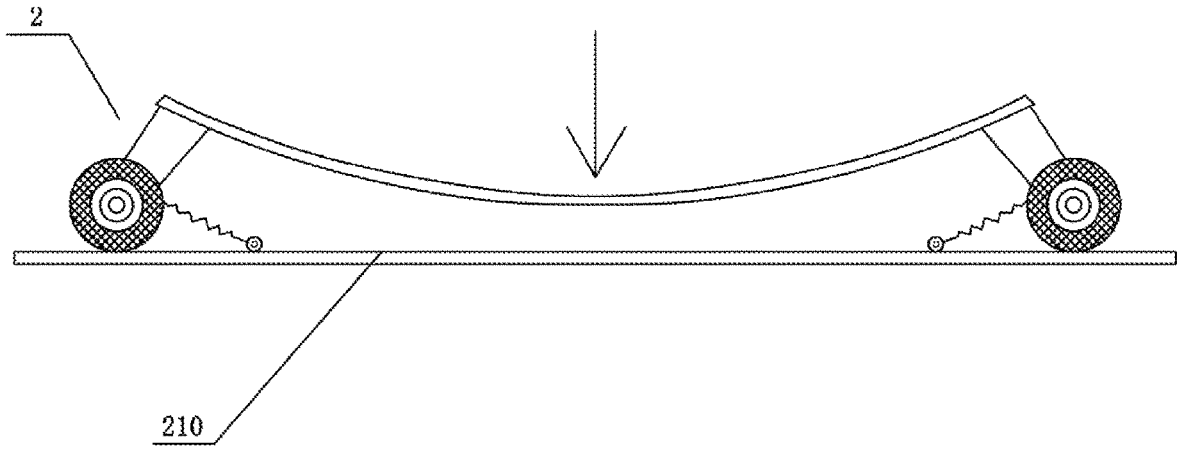
FIG. 26 is a schematic diagram of a trampoline in FIG. 25 when pressed.
Figure 27:
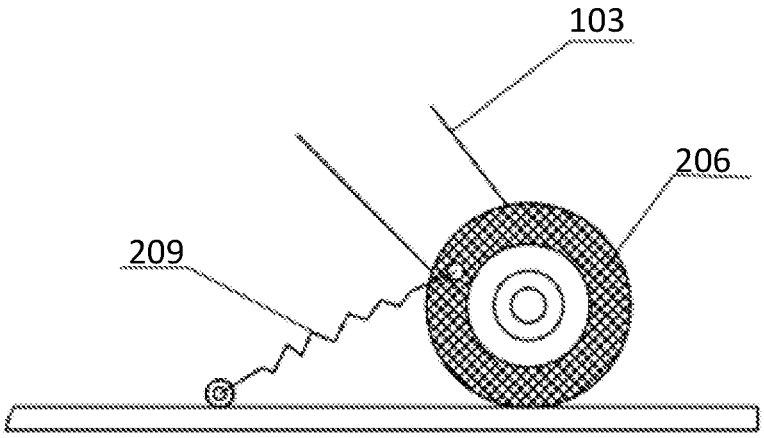
FIG. 27 is a partial structural schematic diagram of a trampoline in FIG. 25.

Similarly, in practical applications, the supporting body 2 also includes a restraint bottom plate 210. The restraint bottom plate 210 is arranged at the bottom of the roller 206, and the restraint base plate 210 may be in an L shape so as to further enhance a limiting restraint effect. A restraint elastic member 209 is arranged between the restraint bottom plate 210 and the roller 206, as shown in FIG. 25. A connecting point between the restraint elastic member 209 and the restraint bottom plate 210 is close to the middle of the elastic plate 1. Similarly, the connecting point between the restraint elastic member 209 and the roller 206 is not on the rotating axis of the roller 206. When the elastic plate 1 is subjected to a force to bent and deform, a downward arrow in the figure indicates a force direction of the elastic plate 1. The rollers 206 at both ends of the elastic plate 1 generate symmetrical and balanced displacement. The restraint elastic member 209 can limit the overall displacement of the rollers 206 at both ends and apply reset force to the rollers 206.

In addition, since the roller 206 only swings reciprocally rather than circularly moves, the roller 206 can be an eccentric wheel or an incomplete wheel to further improve the flexibility of the device.

Embodiment VI

Figure 28:
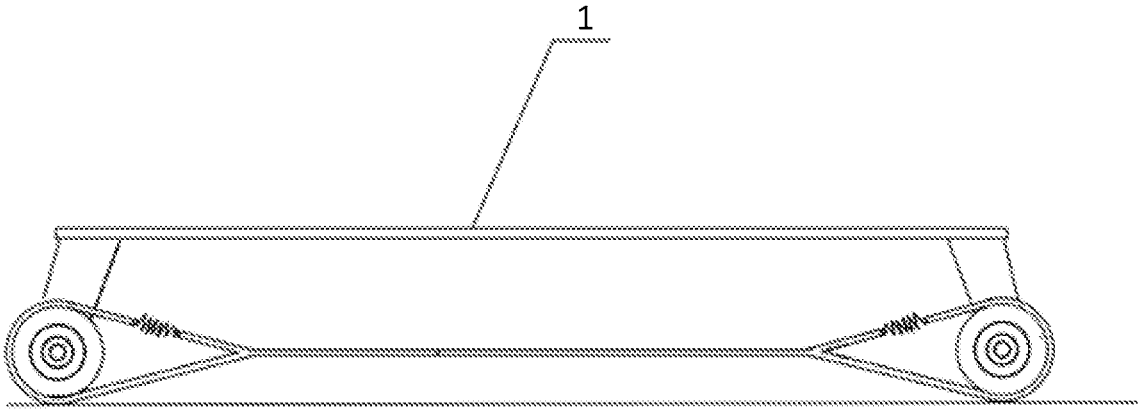
FIG. 28 is a structural schematic diagram of a trampoline in a sixth embodiment of the present disclosure.
Figure 29:
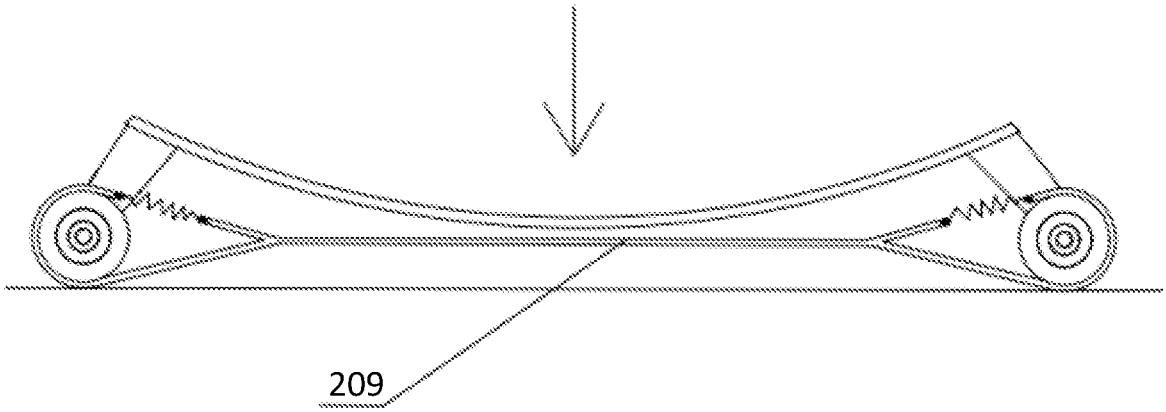
FIG. 29 is a schematic diagram of a trampoline in FIG. 28 when pressed.
Figure 30:
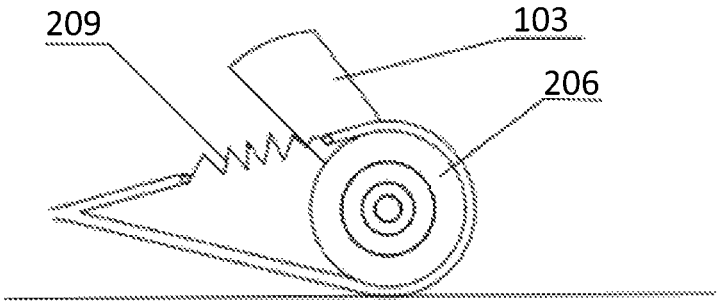
FIG. 30 is a partial structural schematic diagram of a trampoline in FIG. 28.
Figure 31:
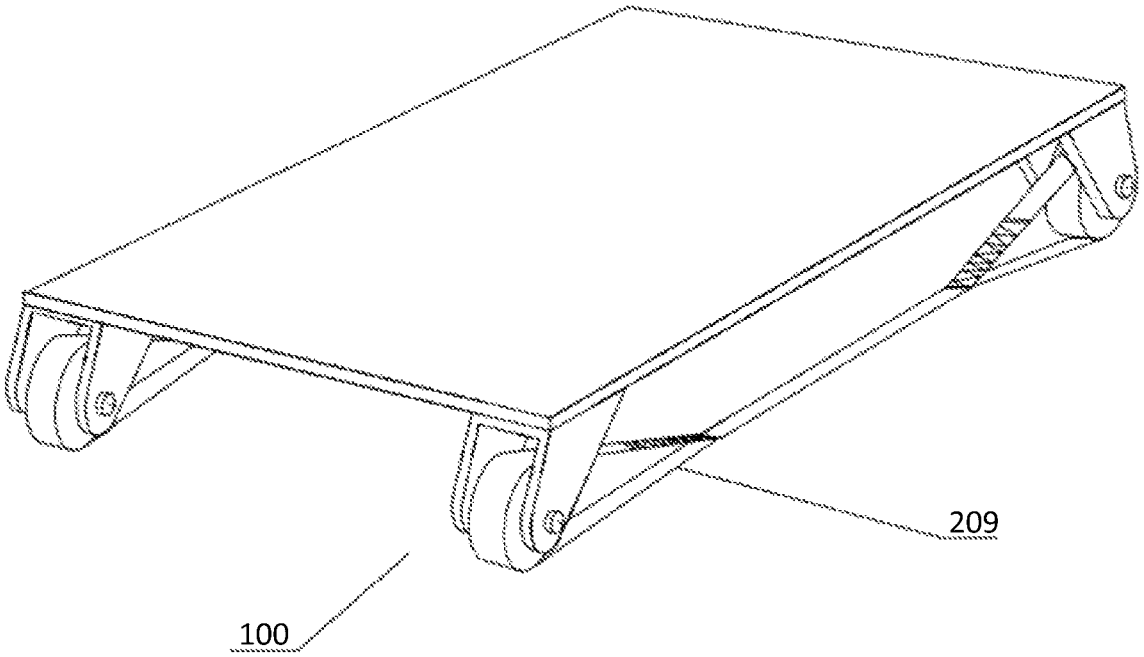
FIG. 31 is an axonometric schematic diagram of a trampoline in the sixth embodiment of the present disclosure.
Figure 32:
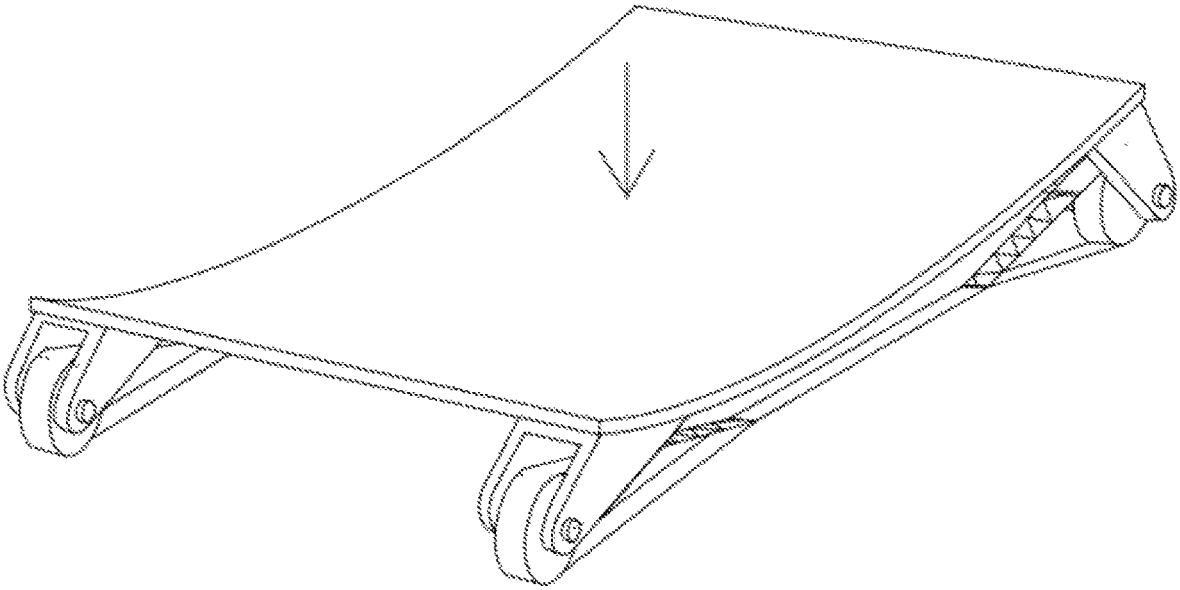
FIG. 32 is a schematic diagram of a trampoline in FIG. 31 when pressed.

In the embodiment, each supporting body 2 includes a roller 206, as shown in FIG. 28. The bottoms of the first end 101 and the second end 102 of the elastic plate 1 are both connected with plate end supports 103. The roller 206 is rotatably connected with a corresponding plate end support 103. An axis of the roller 206 is perpendicular to a connecting line of the first end 101 and the second end 102 of the elastic plate 1. A restraint elastic member 209 is arranged between two adjacent rollers 206 along a direction from the first end 101 to the second end 102 of the elastic plate 1 to apply reset acting force to the roller 206. The restraint elastic member 209 is an elastic belt. The restraint elastic member 209 is in the shape of a pattern "eight". The restraint elastic member 209 sleeves the two adjacent rollers 206. When the middle of the elastic plate 1 is bent downwards, the two plate ends generate symmetrical turning angle changes, the distance between the rollers 206 at the two plate ends is increased, and the restraint elastic member 209 is elongated, and the restraint elastic member 209 applies reaction force to the rollers 206 to restore deformation at the same time, so that the middle of the elastic plate 1 is not subjected to obvious horizontal changes. A tension spring may also be connected in series at the position where the restraint elastic member 209 is close to the rollers 206 to help the rollers 206 rebound and the middle of the elastic plate 1 rebound upwards.

In practical application, the restraint elastic member 209 may be replaced by a double-sided reverse synchronous rope or chain. The double-sided reverse synchronous rope or chain cannot be wound around a peripheral surface of the roller 206, but can be wound around or fixed on a disc with a slightly smaller diameter coaxially fixed to the roller 206, so that the normal rolling motion of the roller 206 is avoided from being influenced, and the working reliability of the device is improved.

Embodiment VII

Figure 33:
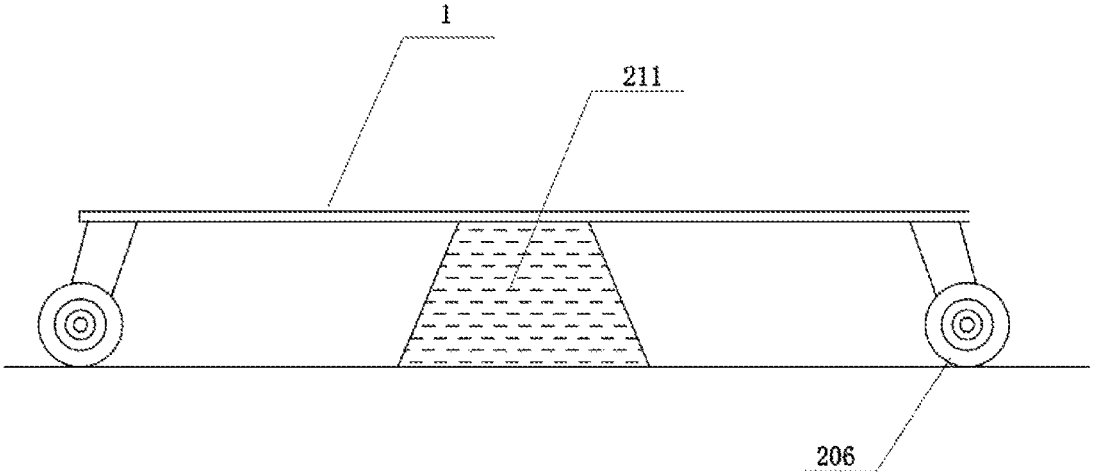
FIG. 33 is a structural schematic diagram of a trampoline in a seventh embodiment of the present disclosure.
Figure 34:
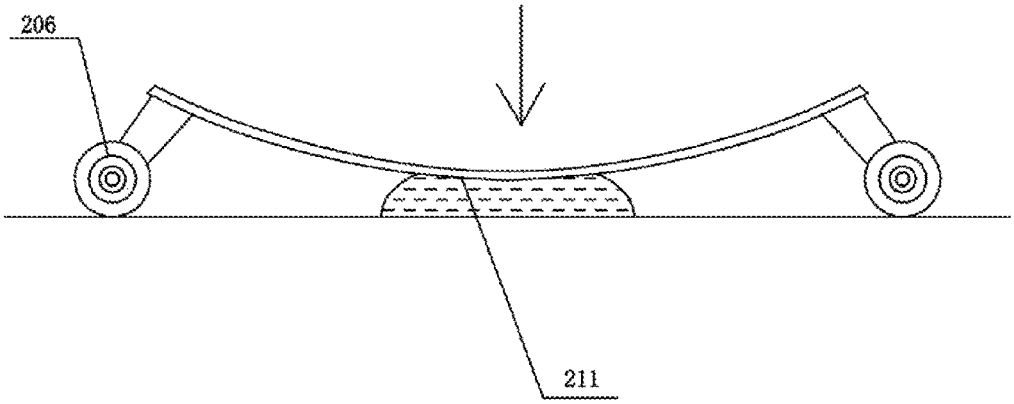
FIG. 34 is a schematic diagram of a trampoline in FIG. 33 when pressed.
Figure 35:
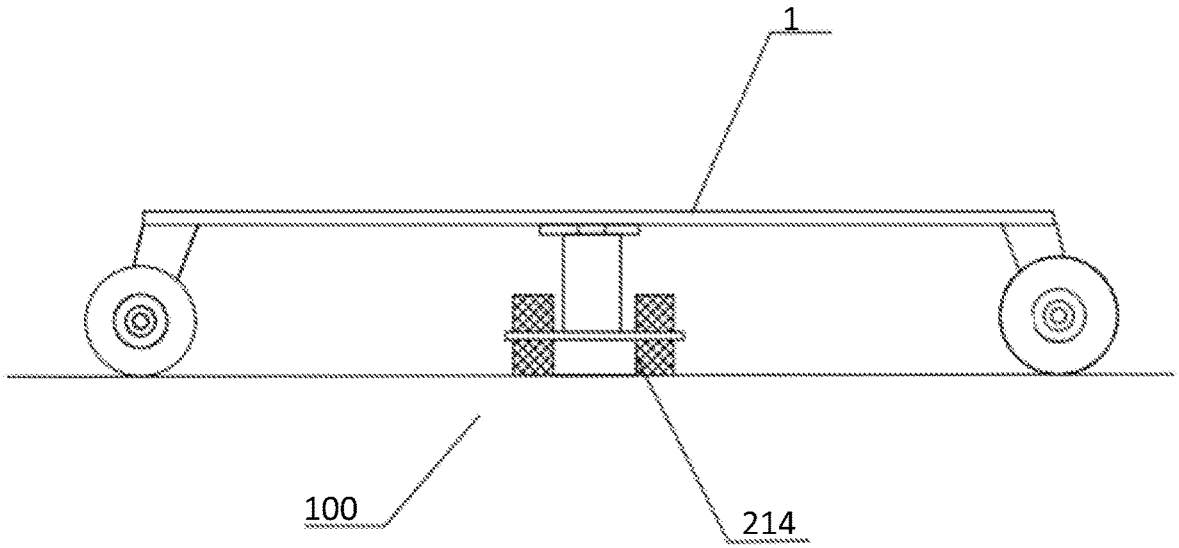
FIG. 35 is a front view of a trampoline in an eighth embodiment of the present disclosure.
Figure 36:
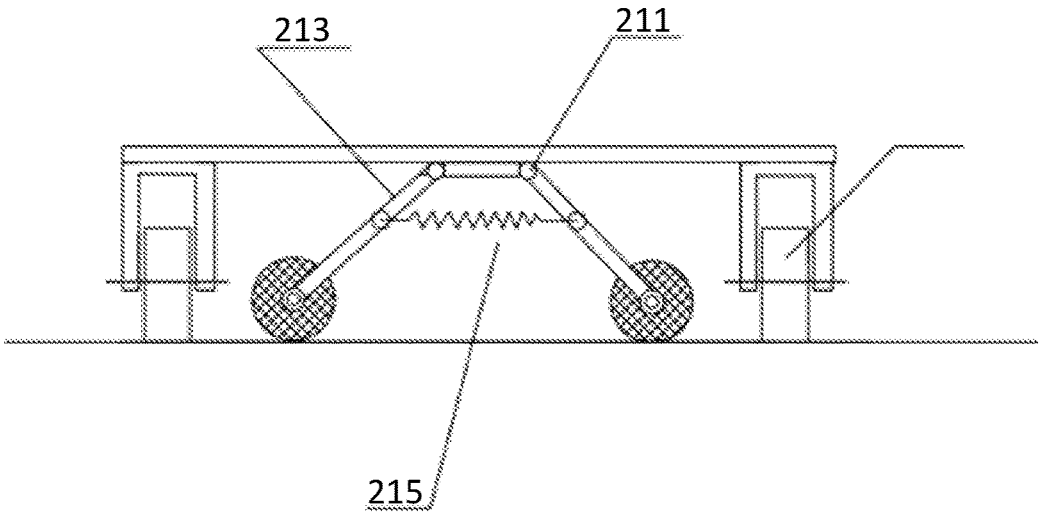
FIG. 36 is a side view of a trampoline in FIG. 35.

In the embodiment, the bottom of the elastic plate 1 is provided with a stop supporting element 211, as shown in FIG. 33. The stop supporting element 211 is located at the symmetric center of the elastic plate 1, wherein the stop supporting element 211 includes a stop supporting table, and the stop supporting table is made of elastic material, such as high-resiliency cellulose sponge, leaf spring and compression spring. The ground of the stop supporting element 211 is closely fitted to the ground, thereby preventing the center of the elastic plate 1 from deviating, and the stop supporting element 211 can also provide buffer for the elastic plate 1 and apply small elastic force to help the middle of the elastic plate 1 rebound upward. When the elastic plate 1 generate obvious concave bending deformation under pressure, both ends of the elastic plate 1 can generate changes in turning angle and horizontal distance. The two plate ends are supported by the supporting bodies 2, and the stop supporting element 211 is arranged at the center of the elastic plate 1 to prevent the elastic plate 1 from moving and provide certain elastic support to the elastic plate 1, so that the whole elastic plate 1 does not significantly displace horizontally, and can be automatically reset after the pressure is eliminated. Since the stop supporting element 211 is additionally arranged, the structural requirements of the device on the supporting body 2 can be correspondingly reduced. According to the specification of the trampoline 100, more than two supporting bodies 2 can be arranged at both ends of the elastic plate 1, and the supporting bodies 2 at the two plate ends are symmetrically arranged, so that a user can vertically move up and down in the middle of the elastic plate 1 by the bending deformation of the elastic plate 1. The stop supporting table can be set in a cylindrical shape or a pyramid frustum shape or other structures according to specific working conditions, so as to meet different requirements of use and improve the flexibility and adaptability of the trampoline 100.

In addition, a grounded part of the stop supporting element 211 can also be additionally provided with a vacuum suction cup 212 to limit vibration and noise generated by inertia after displacement and reset of the elastic plate 1.

The supporting unit of the trampoline 100 in the embodiment can be combined with one or more of the supporting bodies 2 in the first embodiment to the sixth embodiment, and unnecessary details are not given here.

Embodiment VIII

In this embodiment, the bottom of the elastic plate 1 is provided with a stop supporting element 211, and the stop supporting element 211 is located at the symmetric center of the elastic plate 1, wherein the stop supporting element 211 includes elastic arms 213 and guide wheels 214, as shown in FIG. 33. The elastic arms 213 are obliquely arranged from up to down in the direction gradually away from the center of the elastic plate 1. First ends of the elastic arm 213 are hinged to the elastic plate 1, and second ends of the elastic arm 213 are rotatably connected with the guide wheels 214. A rotating axis of each guide wheel 214 is parallel to the direction of a connecting line of the first end 101 and the second end 102 of the elastic plate 1. The number of the elastic arms 213 is two, the two elastic arms 213 are symmetrically arranged. Each elastic arm 213 is connected with at least one guide wheel 214, and the two elastic arms 213 are connected by a connecting element 215 made of elastic material. When the elastic plate 1 moves up and down, the elastic arms 213 are deflected, and the two elastic arms 213 are symmetrically arranged. In the deflection process, the connecting element 215 is pulled to limit the horizontal displacement of the elastic plate 1.

In practical application, the included angle between each elastic arm 213 and the vertical direction can be set to be greater than 30°, so as to make sure, when the elastic plate 1 is deformed under pressure, the elastic arm 213 can generate relative rotation to pull the connecting element 215, so that the range of the overall horizontal displacement of the elastic plate 1 is limited.

The supporting unit of the trampoline 100 in the embodiment can be combined with one or more of the supporting bodies 2 in the first embodiment to the sixth embodiment, and unnecessary details are not given here.

Embodiment IX

Figure 37:
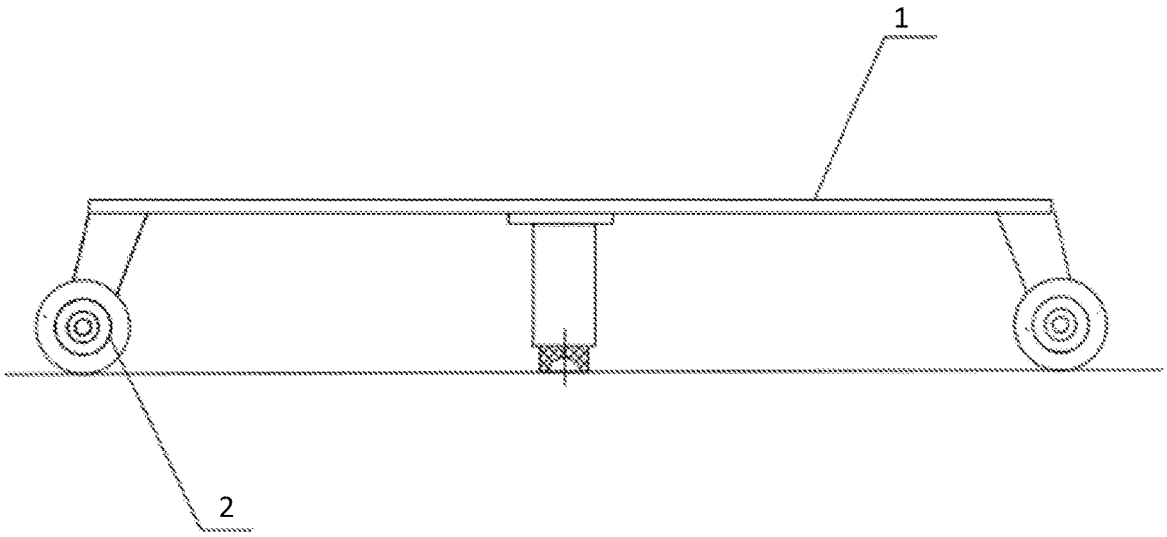
FIG. 37 is a front view of a trampoline in a ninth embodiment of the present disclosure.
Figure 38:
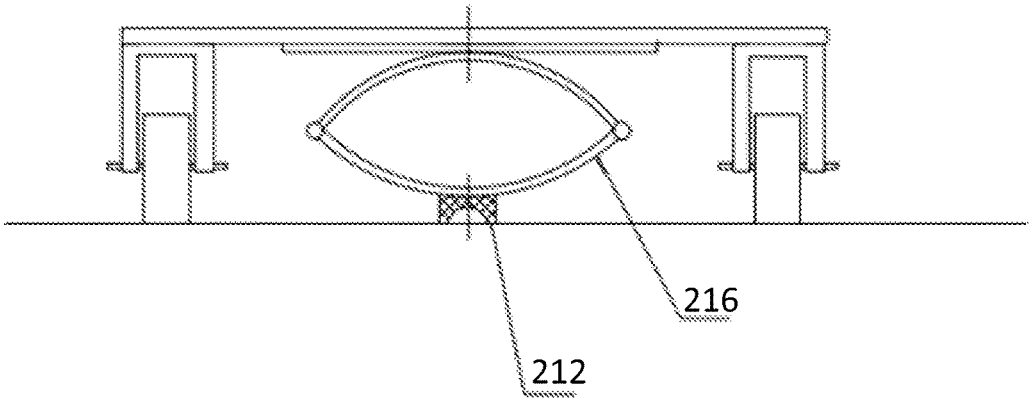
FIG. 38 is a side view of a trampoline in FIG. 37.

In the embodiment, the bottom of the elastic plate 1 is provided with a stop supporting element 211, and the stop supporting element 211 is located at the symmetric center of the elastic plate, wherein the stop supporting element 211 includes two cambered plates 216 symmetrically arranged along the vertical direction, and the two cambered plates 216 are hinged and connected at ends to form a ring, as shown in FIG. 37. When the elastic plate 1 moves downwards, the ring-shaped stop supporting element 211 surrounded by the two cambered plates 216 is compressed, and the height of the ring-shaped stop supporting element 211 is changed to realize a stop purpose of the elastic plate 1.

In addition, the bottom of the cambered plate 216 away from the elastic plate 1 is provide with a vacuum suction cup 212 or a cushion pad to limit vibration and noise generated by inertia after displacement and reset of the elastic plate 1.

The supporting unit of the trampoline 100 in the embodiment can be combined with one or more of the supporting bodies 2 in the first embodiment to the sixth embodiment, and unnecessary details are not given here.

Embodiment X

Figure 39:
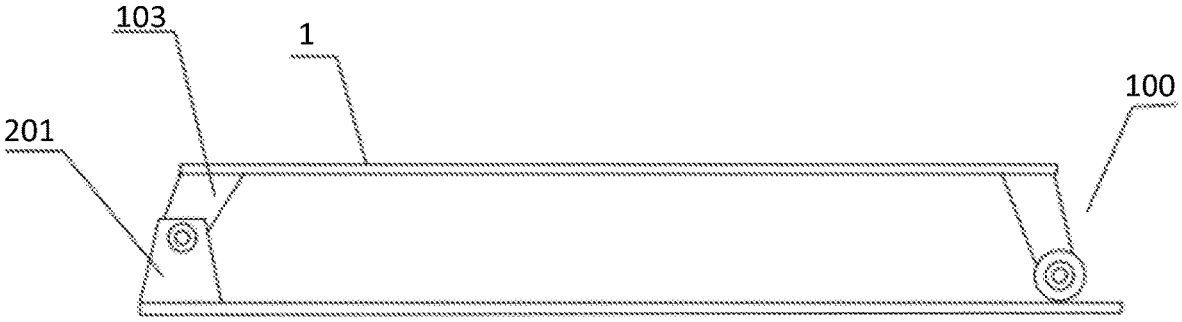
FIG. 39 is a schematic diagram of a trampoline of another structure disclosed in a tenth embodiment of the present disclosure.
Figure 40:
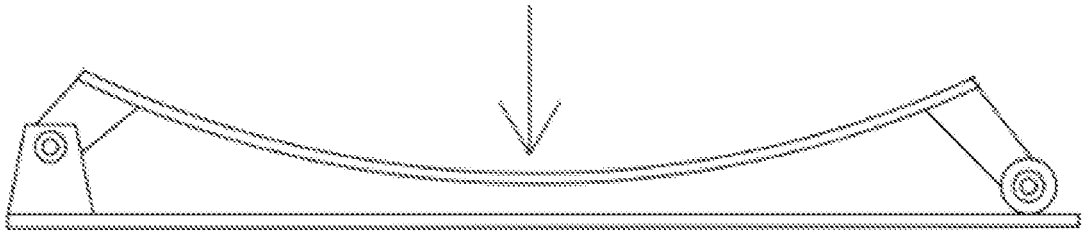
FIG. 40 is a schematic diagram of a trampoline in FIG. 39 when pressed.

According to the trampoline 100 in the embodiment, for the supporting units at both ends of the elastic plate 1, one end is provided with a hinged connector, and the other end is provided with a roller 206, as shown in FIG. 39. The position of the one end provided with the hinged connector in contact with the ground keeps still, and at the other end provided with the roller 206, when the elastic plate 1 is deformed under pressure, the roller 206 rolls relative to the ground so as to adapt to the turning angle changes at the ends of the elastic plate 1. With limited movement of the supporting unit at one end of the roller 206, the changes of the horizontal distance between the two plate ends of the elastic plate 1 caused by the bending of the elastic plate 1 can be adapted. However, the middle of the elastic member 1 is not subjected to little horizontal displacement, and can be automatically reset after the pressure is eliminated.

Figure 51:
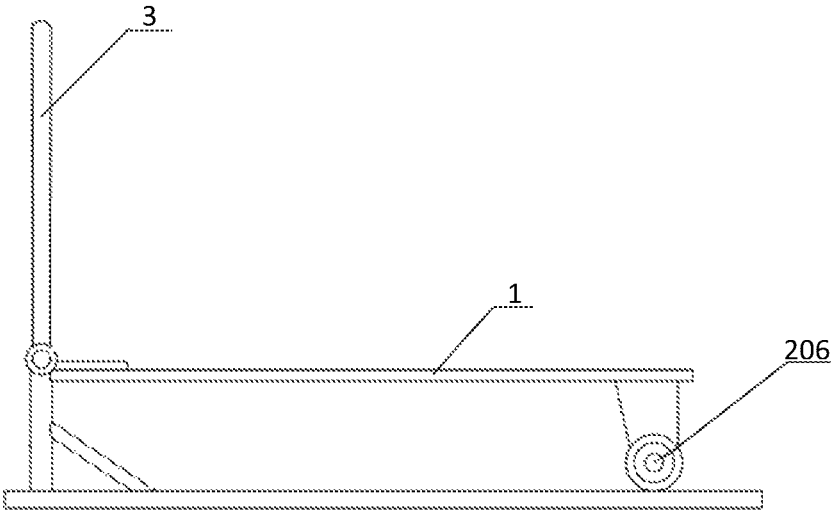
FIG. 51 is a third structural schematic diagram of a trampoline provided with an armrest in the twelfth embodiment of the present disclosure.
Figure 52:
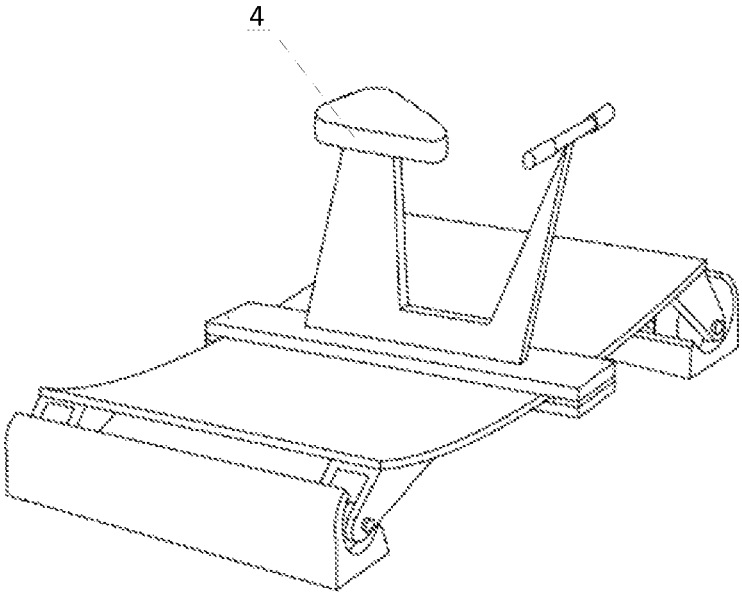
FIG. 52 is a structural schematic diagram of a trampoline provided with a saddle in the twelfth embodiment of the present disclosure.

In practical application, an armrest 3 can be arranged at one end provided with the hinged connector, as shown in FIG. 51, namely the armrest 3 is arranged on the lateral side of a user, so that the using safety factor of the trampoline 100 is further improved, and the user experience is promoted.

Embodiment XI

Figure 41:
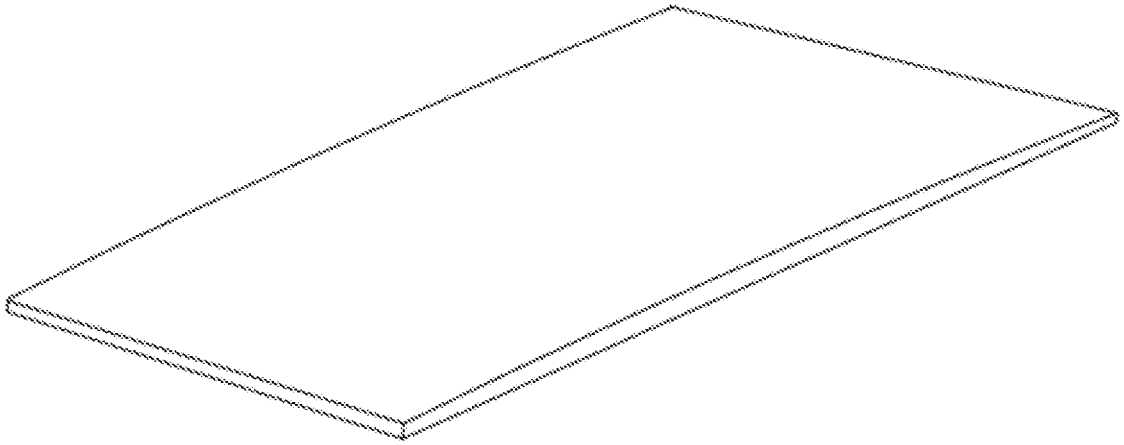
FIG. 41 is a structural schematic diagram of an elastic plate with a variable thickness in an eleventh embodiment of the present disclosure.

In the embodiment, the elastic plate 1 can be set to be of a structure which has a thicker thickness at the middle and decreases gradually along directions from the center of the elastic plate 1 towards the first end 101 and the second end 102, as shown in FIG. 41. The elastic plate 1 is of a thickness variable structure, so that the elasticity of the elastic plate 1 is further enhanced, and the user experience is promoted.

In practical application, the elastic plate 1 can also be of a composite multi-layer structure. For example, composite plates of different material structures are adopted in a surface layer and a middle layer to improve the mechanical properties.

Figure 42:
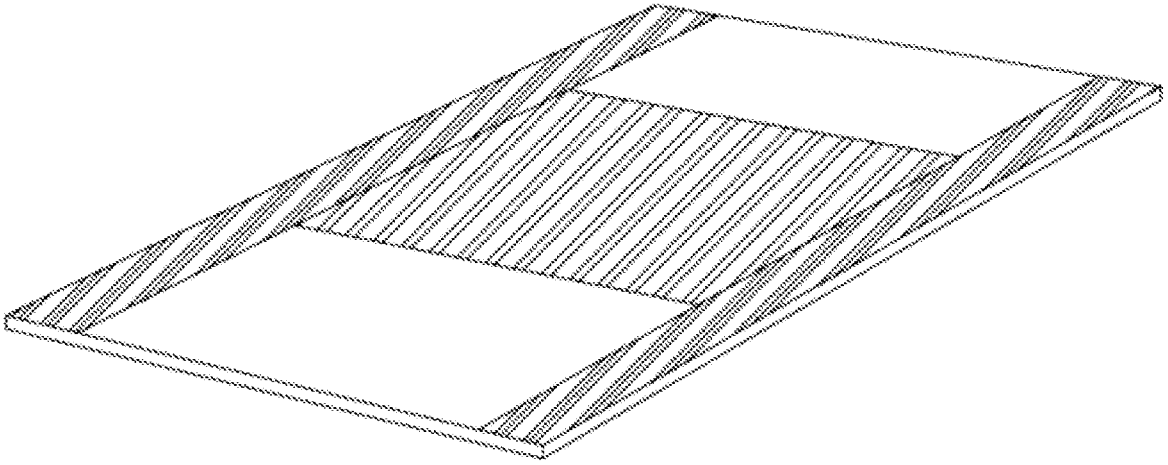
FIG. 42 is a structural schematic diagram of an elastic shaft provided with longitudinal reinforcing ribs or reinforcing plates in the eleventh embodiment of the present disclosure.

Alternatively, the elastic plate 1 is provided with longitudinal reinforcing ribs or a reinforcing plate, as shown in FIG. 42. The reinforcing plate is arranged in the middle of the elastic plate 1 to avoid overbending of the middle.

Figure 43:
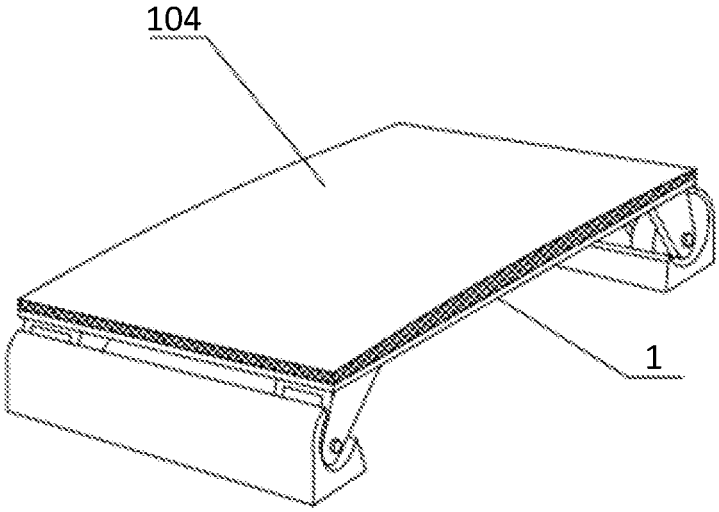
FIG. 43 is a structural schematic diagram of a trampoline provided with a traction reinforcing member on an elastic plate in the eleventh embodiment of the present disclosure.
Figure 44:
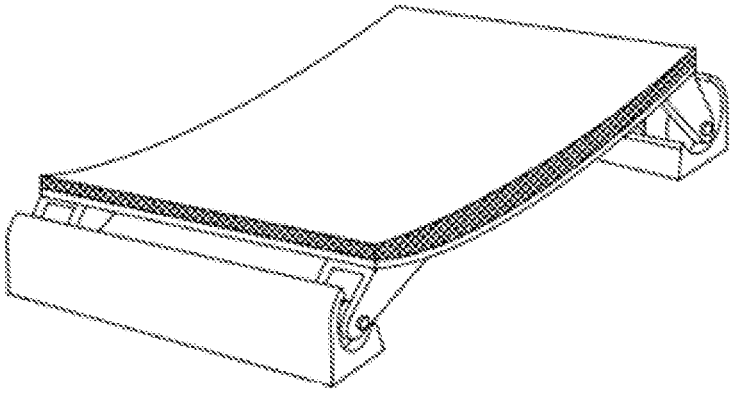
FIG. 44 is a schematic diagram of a trampoline in FIG. 43 when pressed.

Alternatively, the bottom of the elastic plate 1 is provided with a traction reinforcing member 104. For example, the middle of the bottom of the elastic plate 1 is provided with a traction reinforcing member 104 made of high polymer material for grounded cushioning and protection during overbending of the elastic plate 1, as shown in FIG. 43.

Figure 45:
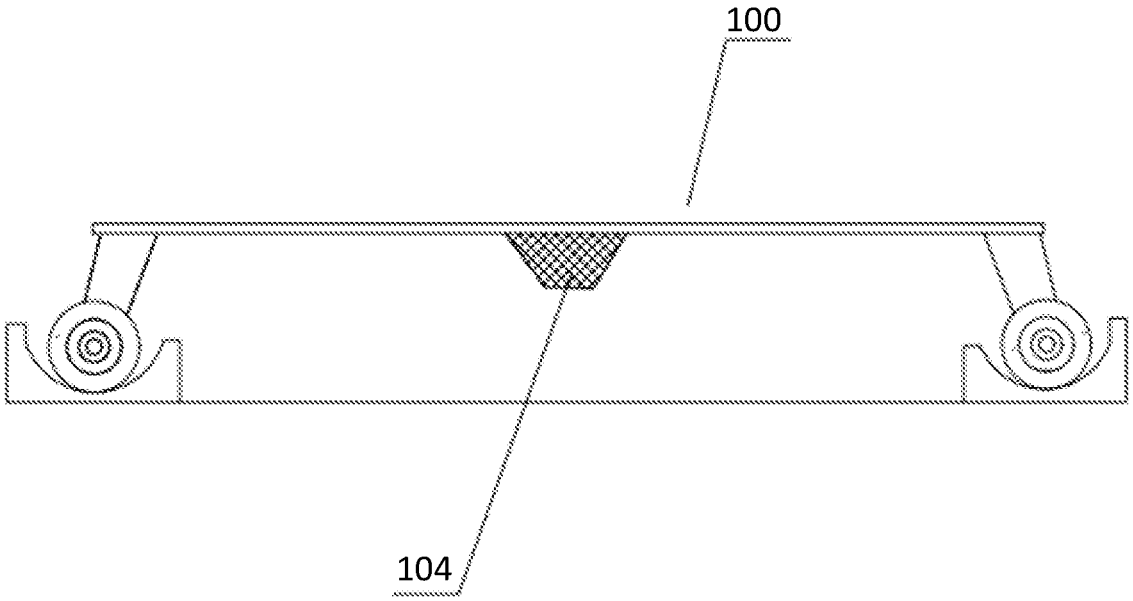
FIG. 45 is a structural schematic diagram of a trampoline provided with a buffer structure layer on an elastic plate in the eleventh embodiment of the present disclosure.

Alternatively, the top of the elastic plate 1 is provided with a buffer structure layer 105. For example, the elastic plate 1 is integrally or locally provided with a buffer structure layer 105 made of high polymer material or woven blankets, as shown in FIG. 45.

Alternatively, surface plates in which a trapezoidal notch gradually becoming narrow is formed are arranged among a plurality of adjacent traction parts at both ends of the elastic plate 1 so as to increase the amplitude of the elastic plate 1 by elastic deformation and enhance the elastic property of the elastic plate 1.

It needs to be noted that the supporting unit of the trampoline 100 in the embodiment can be combined with one or more of the supporting bodies 2 in the first embodiment to the sixth embodiment, and whether a stop supporting element 211 is arranged can be selected according to actual working conditions. The specific structure of the stop supporting element 211 refers to the seventh embodiment to the ninth embodiment, and unnecessary details are not given here.

Embodiment XII

In this embodiment, the connecting positions of the first end 101 and the second end 102 of the elastic plate 1 with the supporting bodies can be adjusted, as shown in FIG. 45. The elastic plate 1 may be connected with the supporting bodies 2 via bolts, and the connecting positions can be adjusted so as to adjust the spacing of the supporting bodies 2 at the two plate ends. The plate end support 103 can also be set to be of a structure with adjustable length and height so as to realize the purpose of adjusting the elastic property and different fluctuating vibration frequencies of the trampoline 100.

Figure 46:
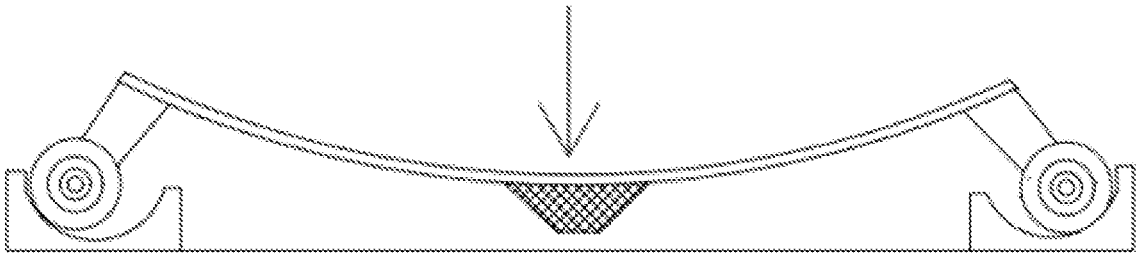
FIG. 46 is a schematic diagram of a trampoline in FIG. 45 when pressed.
Figure 47:
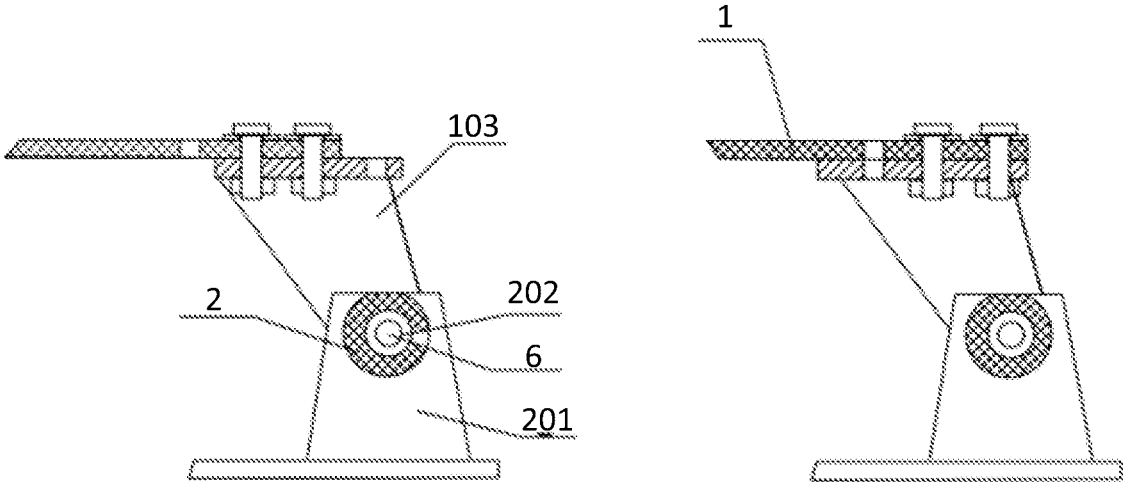
FIG. 47 is a first schematic diagram of connected position adjustment of an elastic plate and a support in a twelfth embodiment of the present disclosure.
Figure 48:
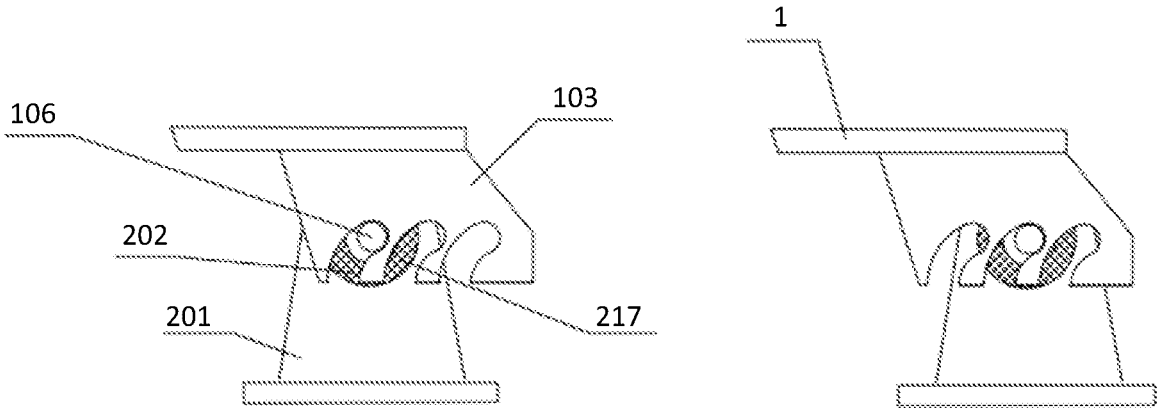
FIG. 48 is a second schematic diagram of the adjustment of connected position of an elastic plate and a support in the twelfth embodiment of the present disclosure.

In practical application, the elastic plate 1 is provided with connecting pins 106. Connecting slots 217 matched with the connecting pins 106 are formed in the supporting body 2. The connecting pins 106 are rotatably arranged in the connecting slots 217. The number of the connecting slots 217 is multiple, and the connecting slots 217 are arranged along the direction of the connecting line of the first end 101 and the second end 102 of the elastic plate 1. The different connecting slots 217 are matched with the connecting pins 106 so as to adjust the spacing of the supporting units, as shown in FIG. 46.

In addition, the projection of the elastic plate 1 on the horizontal plane is rectangular. The length-width ratio of the elastic plate 1 is between 1 and 10. The first end 101 and the second end 102 of the elastic plate 1 are arranged along the length direction of the elastic plate 1. The thickness dimension of the elastic plate 1 is less than one fiftieth of the width dimension of the elastic plate 1. The elastic plate 1 is made of composite material or metal material. The material and dimensions of the elastic plate 1 can be adjusted according to specific working conditions.

Figure 49:
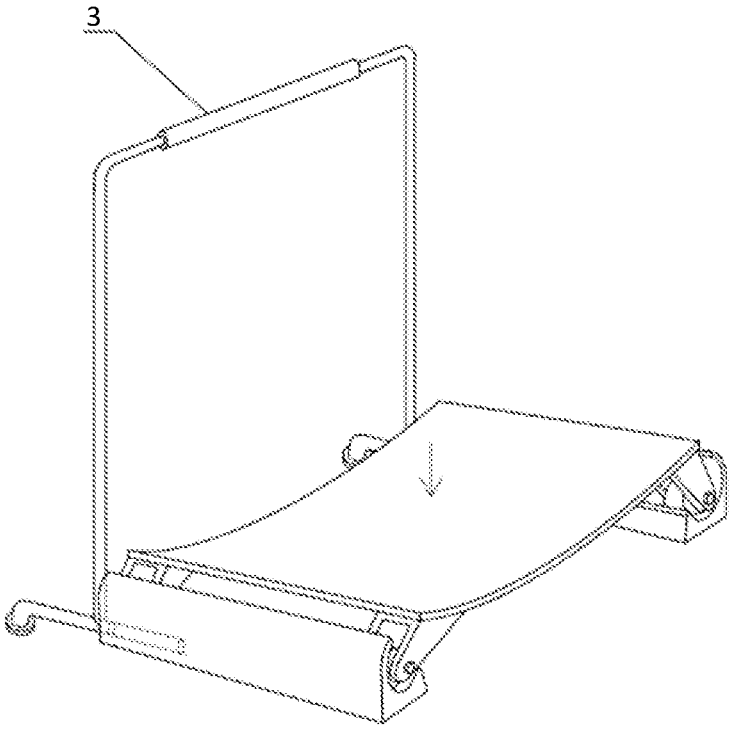
FIG. 49 is a first structural schematic diagram of a trampoline provided with an armrest in the twelfth embodiment of the present disclosure.
Figure 50:
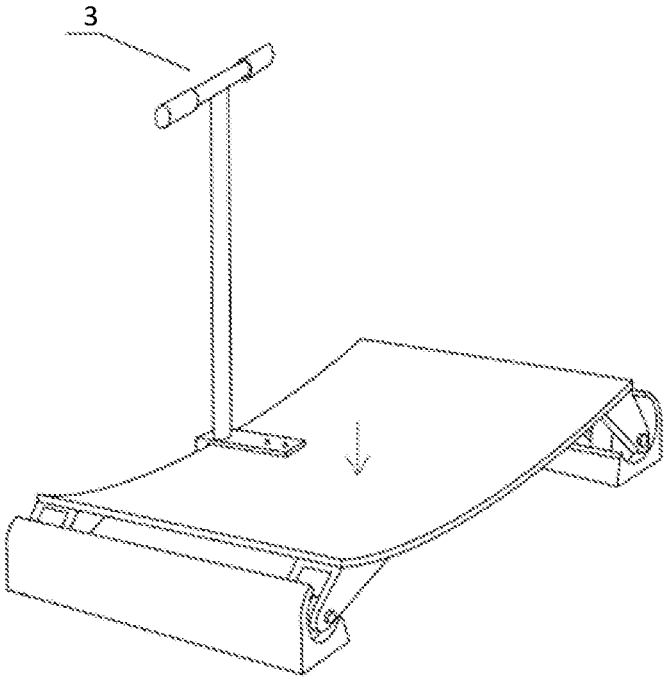
FIG. 50 is a second structural schematic diagram of a trampoline provided with an armrest in the twelfth embodiment of the present disclosure.

Meanwhile, one or several of an armrest 3, a stool, a chair, a saddle 4 and a bed guard are installed on the elastic plate 1, so that a user plays sports in different postures, as shown in FIG. 49 and FIG. 51.

In addition, the elastic plate is 1 provided with an electronic counter or a vibration sensor so as to monitor the number of fluctuating movement times of the elastic plate 1.

It needs to be noted that the supporting unit of the trampoline 100 in the embodiment can be combined with one or more of the supporting bodies 2 in the first embodiment to the sixth embodiment, and whether a stop supporting element 211 is arranged can be selected according to actual working conditions. The specific structure of the stop supporting element 211 refers to the seventh embodiment to the ninth embodiment, and unnecessary details are not given here.

Embodiment XIII

The embodiment provides a sports device. The sports device includes a follow-up bed frame or an overlapping plate, and the trampoline 100. The number of the trampolines 100 is multiple. The trampolines 100 are arranged at the bottom of the follow-up bed frame or the overlapping plate so as to support the follow-up bed frame or the overlapping plate. The sports device is constructed according to requirements, so that the adaptability of the trampoline 100 is promoted.

The structure of the trampoline 100 can be the structure in the first embodiment to the twelfth embodiment, and unnecessary details are not given here.

To sum up, according to the trampoline 100 in the present disclosure, the structure of the elastic plate 1 bilaterally and elastically supported can adapt to and overcome the adverse effects of the turning angles at both ends of the elastic plate 1 and the change of the horizontal distance between both ends of the elastic plate 1 due to the bending of the elastic plate 1 on bilateral support, so that the vertical fluctuating movement of the bilaterally supported elastic plate 1 is realized.

Specific examples are used for illustration of the principles and implementation methods of the present disclosure. The description of the above-mentioned embodiments is used to help illustrate the method and its core principles of the present disclosure. In addition, those skilled in the art can make various modifications in terms of specific embodiments and scope of application in accordance with the teachings of the present disclosure. In addition, those skilled in the art can combine one or more features described above with respect to an individual embodiment with other one or more features described above with respect to an additional embodiments, or multiple other embodiments, without departing from scope hereof. Thus, just because one embodiment describes a given feature and another embodiment does not expressly describe said given feature, said given feature may be utilized with the another embodiment that doesn't expressly describe said given feature. In summary, the contents of this specification should not be understood as the limitation of the present disclosure.

What is claimed is:

1. A trampoline, comprising:

an elastic plate, wherein the elastic plate comprises a first end and a second end, and a portion, located between the first end and the second end, of the elastic plate is an elastic energy accumulator;

a supporting unit, wherein the supporting unit comprises supporting bodies arranged at the first end and the second end of the elastic plate, and the supporting bodies are capable of supporting the elastic plate and tensioning the first end and the second end of the elastic plate; during bending deformation of the elastic plate, the supporting bodies are subjected to elastic deformation, or first supporting-plate ends, connected with the elastic plate, of the supporting bodies rotate and horizontally displace relative to second supporting-plate ends, away from the elastic plate, of the supporting bodies to accumulate potential energy, and the first end generates a symmetrical turning angle change with respect to the second end; during deformation recovering of the elastic plate, the supporting bodies apply reset force to the first end and the second end by utilizing the potential energy, so that displacement of the elastic energy accumulator in a horizontal direction is limited during the bending deformation and deformation recovering of the elastic plate;

wherein each of the supporting bodies comprises a roller, bottoms of the first end and the second end of the elastic plate are respectively connected with plate end supports of a plurality of plate end supports, the roller is rotatably connected with a corresponding plate end support of the plurality of plate end supports, an axis of the roller is perpendicular to a connecting line of the first end and the second end of the elastic plate;

wherein the supporting body also comprises a roller support, a rolling groove matched with the roller is formed in the roller support, the roller is rotatably arranged in the rolling groove and is movable horizontally in the rolling groove, and elastic buffer material is internally provided inside the rolling groove;

wherein a restraint elastic member is arranged between the roller support and the corresponding plate end support to apply a reset force to the roller, wherein the restraint elastic member is a spring.

2. The trampoline according to claim 1, wherein a bottom of the elastic plate is provided with a stop supporting element located at a symmetric center of the elastic plate; and wherein the stop supporting element comprises a stop supporting table, made of elastic material;

or, the stop supporting element comprises elastic arms and guide wheels, first ends of the elastic arms are hinged to the elastic plate, second ends of the elastic arms are rotatably connected with the guide wheels, a number of the elastic arms is two, two elastic arms are symmetrically arranged, each of the elastic arms is connected with at least one guide wheel, and the two elastic arms are connected by a connecting element made of elastic material;

or, the stop supporting element comprises two cambered plates symmetrically arranged along a vertical direction, and the two cambered plates are hinged and connected at ends to form a ring; and bottoms of the stop supporting table and the cambered plate away from the elastic plate are both provided with vacuum suction cups or cushion pads.

3. The trampoline according to claim 1, wherein a thickness of the elastic plate is a first thickness at middle, and decreases with respect to the first thickness gradually along directions from a center of the elastic plate towards the first end and the second end;

or, the elastic plate is of a composite multi-layer structure;

or, the elastic plate is provided with longitudinal reinforcing ribs or a reinforcing plate, and the reinforcing plate is arranged in a middle of the elastic plate;

or, the bottom of the elastic plate is provided with a traction reinforcing member;

or, a top of the elastic plate is provided with a buffer structure layer;

or, both ends of the elastic plate are provided with surface plates in which a trapezoidal notch is formed.

4. The trampoline according to claim 1, wherein a number of the supporting bodies, connected with the first end and the second end, of the elastic plate is at least two, and connecting positions of the first end and the second end of the elastic plate with the supporting bodies can be adjusted;

wherein the elastic plate is connected with the supporting bodies via bolts, and the connecting positions can be adjusted;

or, the elastic plate is provided with connecting pins, a plurality of connecting slots matched with the connecting pins are formed in each of the supporting bodies, the connecting pins are rotatably arranged in the plurality of connecting slots, and the plurality of connecting slots are arranged along the direction of the connecting line of the first end and the second end of the elastic plate.

5. The trampoline according to claim 1, wherein a projection of the elastic plate on a horizontal plane is rectangular, a length-width ratio of the elastic plate is between 1 and 10, the first end and the second end of the elastic plate are arranged along a length direction of the elastic plate, and a thickness of the elastic plate is less than one fiftieth of a width of the elastic plate; the elastic plate is made of composite material or metal material;

one or several of an armrest, a stool, a chair, a saddle and a bed guard are installed on the elastic plate; and the elastic plate is provided with an electronic counter or a vibration sensor so as to monitor the times of fluctuating movement of the elastic plate.

6. A sports device, comprising a follow-up bed frame or an overlapping plate, wherein the sports device comprises the trampoline according to claim 1, the sports device comprises a plurality of sets of the trampoline, and the plurality of sets of the trampoline are arranged at a bottom of the follow-up bed frame or the overlapping plate.

7. The sports device according to claim 6, wherein a bottom of the elastic plate is provided with a stop supporting element located at a symmetric center of the elastic plate; and wherein the stop supporting element comprises a stop supporting table, made of elastic material;

or, the stop supporting element comprises elastic arms and guide wheels, first ends of the elastic arms are hinged to the elastic plate, second ends of the elastic arms are rotatably connected with the guide wheels, a number of the elastic arms is two, two elastic arms are symmetrically arranged, each of the elastic arms is connected with at least one guide wheel, and the two elastic arms are connected by a connecting element made of elastic material;

or, the stop supporting element comprises two cambered plates symmetrically arranged along a vertical direction, and the two cambered plates are hinged and connected at ends to form a ring; and bottoms of the stop supporting table and the cambered plate away from the elastic plate are both provided with vacuum suction cups or cushion pads.

8. The sports device according to claim 6, wherein a thickness of the elastic plate is a first thickness at middle, and decreases with respect to the first thickness gradually along directions from a center of the elastic plate towards the first end and the second end;

or, the elastic plate is of a composite multi-layer structure;

or, the elastic plate is provided with longitudinal reinforcing ribs or a reinforcing plate, and the reinforcing plate is arranged in a middle of the elastic plate;

or, the bottom of the elastic plate is provided with a traction reinforcing member;

or, a top of the elastic plate is provided with a buffer structure layer;

or, both ends of the elastic plate are provided with surface plates in which a trapezoidal notch is formed.

9. The sports device according to claim 6, wherein a number of the supporting bodies, connected with the first end and the second end, of the elastic plate is at least two, and connecting positions of the first end and the second end of the elastic plate with the supporting bodies can be adjusted;

wherein the elastic plate is connected with the supporting bodies via bolts, and the connecting positions can be adjusted;

or, the elastic plate is provided with connecting pins, a plurality of connecting slots matched with the connecting pins are formed in each of the supporting bodies, the connecting pins are rotatably arranged in the plurality of connecting slots, and the plurality of connecting slots are arranged along the direction of the connecting line of the first end and the second end of the elastic plate.

10. The sports device according to claim 6, wherein a projection of the elastic plate on a horizontal plane is rectangular, a length-width ratio of the elastic plate is between 1 and 10, the first end and the second end of the elastic plate are arranged along a length direction of the elastic plate, and a thickness of the elastic plate is less than one fiftieth of a width of the elastic plate; the elastic plate is made of composite material or metal material;

one or several of an armrest, a stool, a chair, a saddle and a bed guard are installed on the elastic plate; and the elastic plate is provided with an electronic counter or a vibration sensor so as to monitor the times of fluctuating movement of the elastic plate.

* * * * *